US007794372B1

(12) United States Patent
Webber et al.

(10) Patent No.: US 7,794,372 B1
(45) **Date of Patent: *Sep. 14, 2010**

(54) LEG PRESS EXERCISE MACHINE WITH SELF-ALIGNING PIVOTING SEAT

(75) Inventors: Randall T. Webber, La Jolla, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 64 days.

This patent is subject to a terminal disclaimer.

(21) Appl. No.: 12/183,455

(22) Filed: Jul. 31, 2008

Related U.S. Application Data

(60) Provisional application No. 60/953,560, filed on Aug. 2, 2007.

(51) Int. Cl.
*A63B 21/00* (2006.01)
*A63B 23/04* (2006.01)

(52) U.S. Cl. ..... 482/100; 482/137; 482/142

(58) Field of Classification Search ..... 482/92–101, 482/136, 137, 142, 145
See application file for complete search history.

(56) References Cited

U.S. PATENT DOCUMENTS

| | | | | |
|---|---|---|---|---|
| 3,116,062 | A | 12/1963 | Zinkin | |
| 3,917,262 | A | 11/1975 | Salkeld | |
| 4,149,714 | A | 4/1979 | Lambert, Jr. | |
| 5,106,081 | A | 4/1992 | Webb | |
| 5,263,914 | A | 11/1993 | Simonson et al. | |
| 5,366,432 | A | 11/1994 | Habing et al. | |
| 5,484,365 | A | 1/1996 | Jones et al. | |
| 5,527,243 | A * | 6/1996 | Chen | 482/72 |
| 5,549,533 | A | 8/1996 | Olson et al. | |
| 5,554,086 | A | 9/1996 | Habing et al. | |
| 5,616,107 | A | 4/1997 | Simonson | |
| 5,628,715 | A | 5/1997 | Simonson | |
| D383,814 | S * | 9/1997 | Ward | D21/674 |
| 5,669,865 | A * | 9/1997 | Gordon | 482/142 |
| 5,702,328 | A | 12/1997 | Mansvelt | |
| 5,711,749 | A * | 1/1998 | Miller | 482/135 |
| 5,722,918 | A * | 3/1998 | Lee | 482/72 |
| 5,749,813 | A | 5/1998 | Domzalski | |
| 6,220,993 | B1 | 4/2001 | Sencil | |
| 6,264,588 | B1 * | 7/2001 | Ellis | 482/137 |

(Continued)

OTHER PUBLICATIONS

Body Masters brochure, 2002.

(Continued)

*Primary Examiner*—Loan Thanh
*Assistant Examiner*—Victor K Hwang
(74) *Attorney, Agent, or Firm*—Procopio, Cory, Hargreaves & Savitch LLP

(57) ABSTRACT

A leg press machine has a floor engaging main frame, a user support pivot, a user support assembly pivotally mounted on the main frame via the user support pivot, and a pivotally mounted exercise arm assembly having a main exercise arm and a user engaging footplate. A connecting link, which may be a direct connection between the user support and exercise arm, translates movement of the exercise arm assembly to movement of the user support assembly so that pivotal movement in the exercise arm assembly results in a self-aligning, pivoting movement of the user support assembly.

64 Claims, 34 Drawing Sheets

U.S. PATENT DOCUMENTS

| | | | | |
|---|---|---|---|---|
| 6,287,241 | B1 | 9/2001 | Ellis | |
| 6,605,024 | B2 | 8/2003 | Stearns | |
| D481,428 | S | 10/2003 | Giannelli et al. | |
| 6,659,919 | B2 | 12/2003 | Deola | |
| 6,676,577 | B2 | 1/2004 | Stearns | |
| 6,743,158 | B2 | 6/2004 | Giannelli et al. | |
| 6,916,278 | B2 | 7/2005 | Webber | |
| 7,052,444 | B2 | 5/2006 | Webber | |
| 7,220,221 | B2 * | 5/2007 | Mosimann et al. | 482/100 |
| 7,594,880 | B2 * | 9/2009 | Webber et al. | 482/96 |
| 7,670,269 | B2 * | 3/2010 | Webber et al. | 482/94 |
| 2005/0032611 | A1 | 2/2005 | Webber et al. | |
| 2006/0148625 | A1 * | 7/2006 | Garner | 482/123 |
| 2007/0037673 | A1 * | 2/2007 | Giannelli et al. | 482/95 |
| 2007/0270290 | A1 * | 11/2007 | Mosimann et al. | 482/100 |
| 2008/0153677 | A1 | 6/2008 | Webber | |

OTHER PUBLICATIONS

Hoist brochure, 1993.
Hoist HLP brochure, 1998.
Keiser brochure, 1999.
Gym 80 brochure, 2001.
Paramount selectorized unit, 2000.
Paramount plate loaded unit, 2002.
Tuff Stuff brochure, date unknown.
Schwinn Natural Strength, Schwinn magazine Ad, date unknown.

* cited by examiner

LEG PRESS EXERCISE MACHINE WITH SELF-ALIGNING PIVOTING SEAT

RELATED APPLICATION

The present application claims the benefit of co-pending U.S. provisional patent application No. 60/953,560 filed Aug. 2, 2007, which is incorporated herein by reference in its entirety.

BACKGROUND

1. Field of the Invention

This invention relates generally to exercise machines, and is particularly concerned with a leg press exercise machine.

2. Related Art

The most widely performed free weight exercise for the lower body is the barbell squat. It is a compound movement exercise, requiring the movement of multiple joints, specifically the knee and hip, and multiple body parts, specifically the upper and lower legs. To perform the exercise, an exerciser stands erect, places a weighted bar across their shoulders and bends at the knees, squatting downward until the upper thighs are parallel to the floor. During the exercise, it is important to maintain a certain body alignment. The head should be upright, eyes looking forward; feet should be approximately shoulder width apart; the back should remain straight; and the knees should point forward and be positioned over the toes in the squat or low position of the exercise movement. Balance is a critical part of the exercise as unwanted front to back or side to side movement could create instability and disrupt alignment, which in turn could result in injury.

The leg press machine was designed to provide a safer squatting exercise by eliminating the problem of balance and stability. These machines reverse the start and finish positions by placing the user in the compressed or squat position at the start of the exercise and in the extended position with their legs straight at the end of the exercise. One version of a leg press consists of a stationary user support with a movable exercise arm. The user either sits upright or reclines in a prone or semi-prone position, places their feet upon a footplate attached to the exercise arm and pushes the arm forward. A variation of this design has the footplate stationary and the user support movable. In both these scenarios, the movement of the user support or exercise arm could be arcuate or linear.

While the movement is similar to a free weight squat, these leg press machines do not provide the same body alignment or positioning because they do not adjust the position of the user to the position of the footplate during the exercise movement. During a free weight squat, the body is constantly making minor adjustments to keep the feet, knees and back in proper alignment. This adjustment does not take place just at the beginning or end of the exercise; it happens continuously throughout the entire movement and, although balancing a bar on ones shoulders while bending at the knees can be tricky, it forces core stabilizing muscles in the abdomen and low back to be involved. Leg press machines that utilize a pivoting exercise arm can cause an exaggerated arcing movement during the exercise. An unnatural straight line movement is produced in leg press machines that utilize a linear movement exercise arm. Neither of these exercise machines provides body positioning equivalent to that of a free weight, barbell squat.

Therefore, what is needed is a system and method that reduces or overcomes these significant problems found in the conventional systems as described above.

SUMMARY

A leg press exercise machine in one embodiment has a pivoting seat and backrest which automatically align with the exercise arm to aid in maintaining positioning of a user throughout an exercise motion.

The leg press machine in one embodiment comprises a floor engaging main frame, a user support pivot, a user support assembly pivotally mounted on the main frame via the user support pivot, a pivotally mounted exercise arm assembly comprising a main exercise arm and a user engaging footplate, and a connecting link which links movement of the user exercise arm to movement of the user support assembly. A load provides resistance to movement of the user support assembly, exercise arm assembly and/or connecting link. The connecting link and pivot mounts are arranged so that pivotal movement of the exercise arm results in self-aligning movement of the user support assembly.

The exercise arm assembly is movably mounted relative to the main frame, the user support assembly or the connecting link and has a user-engaging footplate approximate its outward end. The connecting link is movably associated with the exercise arm assembly and at least one of the other elements (main frame, user support assembly or user support pivot), so that movement in the exercise arm translates into movement in the user support assembly. The connecting link in one embodiment is a direct pivotal connection between the user support assembly and exercise arm.

The user support assembly in one embodiment comprises a user support frame and primary and secondary user supports on the user support frame. An additional, stabilizing support may also be provided on the support frame. All of the user supports are fixed relative to one another to move together during an exercise. In one embodiment, the user support frame is adjustably mounted on a user support base which is pivotally mounted on the main frame. The adjustable mounting allows the spacing between the support frame and exercise arm to be adjusted for different height users, and a locking device locks the user support frame in a selected adjusted position during an exercise. In another embodiment, the user support frame is pivotally mounted relative to the main frame. One of the user supports may be adjustably mounted on the user support frame in this embodiment, and a locking device releasably locks the adjustable user support in a selected position during an exercise.

To perform the exercise, the user positions themselves on the primary support, with a portion of their body braced against the secondary support, and grabs the stabilizing support. They then place their feet on the user engaging footplate of the exercise arm and push it forward. This moves the connecting link, which in turn forces the user support assembly to rotate about its pivotal connection to the main frame. It places the user in a back supported starting position with their feet, knees and hips in a predetermined alignment, then adjusts that position, following the natural pivoting movement of the angles, knees and hips as the users legs straighten, replicating the motion of a barbell squat. This combined movement of seat and exercise arm provides a safer, more natural feeling exercise motion that constantly adjusts the position of the user during the exercise. Because the user support moves in conjunction with the exercise arm, the arcuate path of the exercise arm relative to the user support is reduced. The result is a more natural feeling exercise movement that more closely replicates the movement found in the corresponding free weight exercise.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
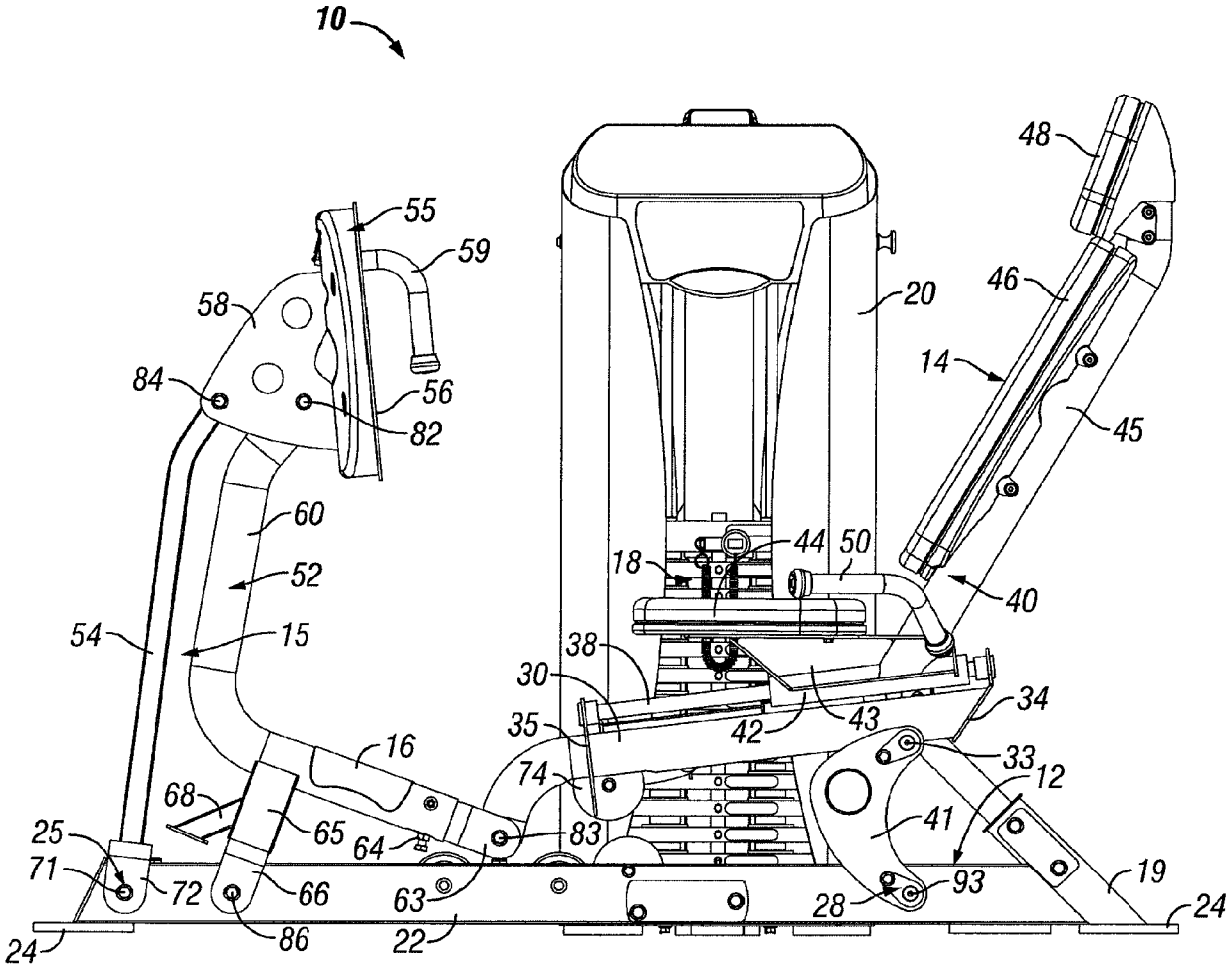
FIG. 1 is a side elevation view of a leg press exercise machine according to a first embodiment.

Certain embodiments as disclosed herein provide for a leg press exercise machine. In certain embodiments disclosed herein, a leg press exercise machine has an exercise arm and user support which travel in a dependent relationship.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 17 illustrate a first embodiment of a leg press exercise machine 10 which has a floor-engaging main frame 12, a user support assembly 14 and an exercise arm assembly 15 both pivotally mounted on the frame 12, a connecting link 16 which links movement of the exercise arm assembly 15 to movement of the user support assembly 14, and a selectorized weight stack 18 in a weight stack housing 20, the weight stack providing an exercise resistance or load. The weight stack assembly is a standard selectorized weight stack as known in the field, and has a vertical weight stack support frame which is connected to the main frame and houses a weight stack 18 running on two guide rods.

Figure 3:
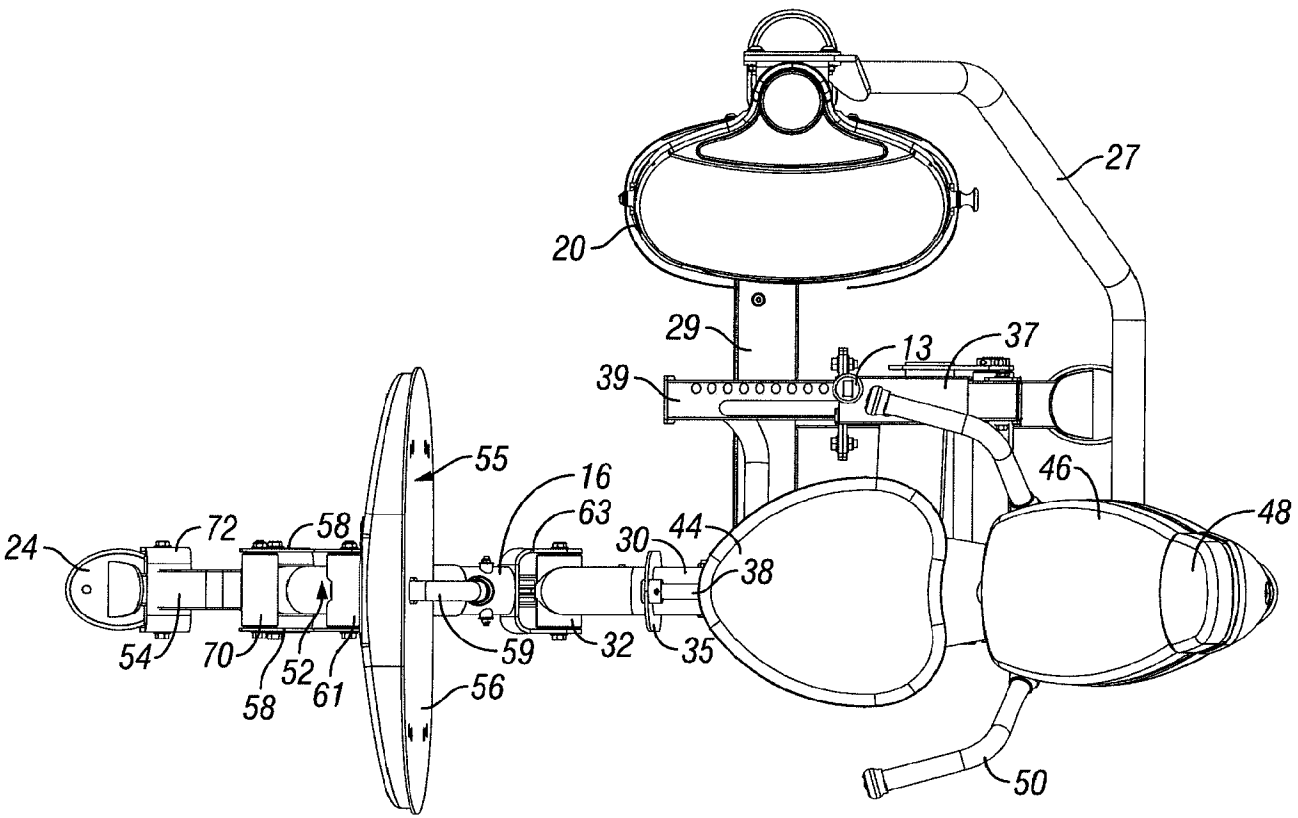
FIG. 3 is a top plan view of the machine of FIGS. 1 and 2.
Figure 4:
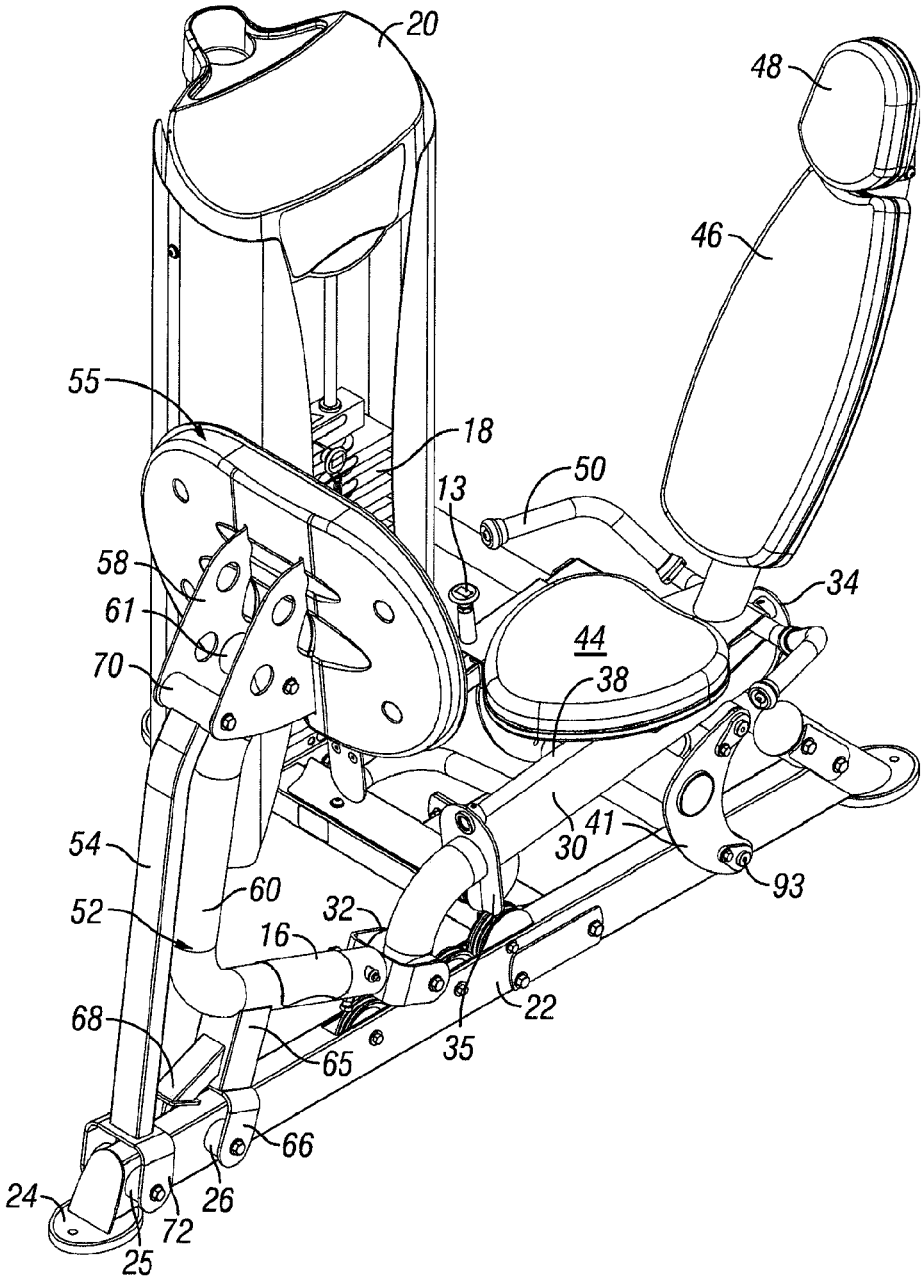
FIG. 4 is a front perspective view of the machine of FIGS. 1 to 3.
Figure 5:
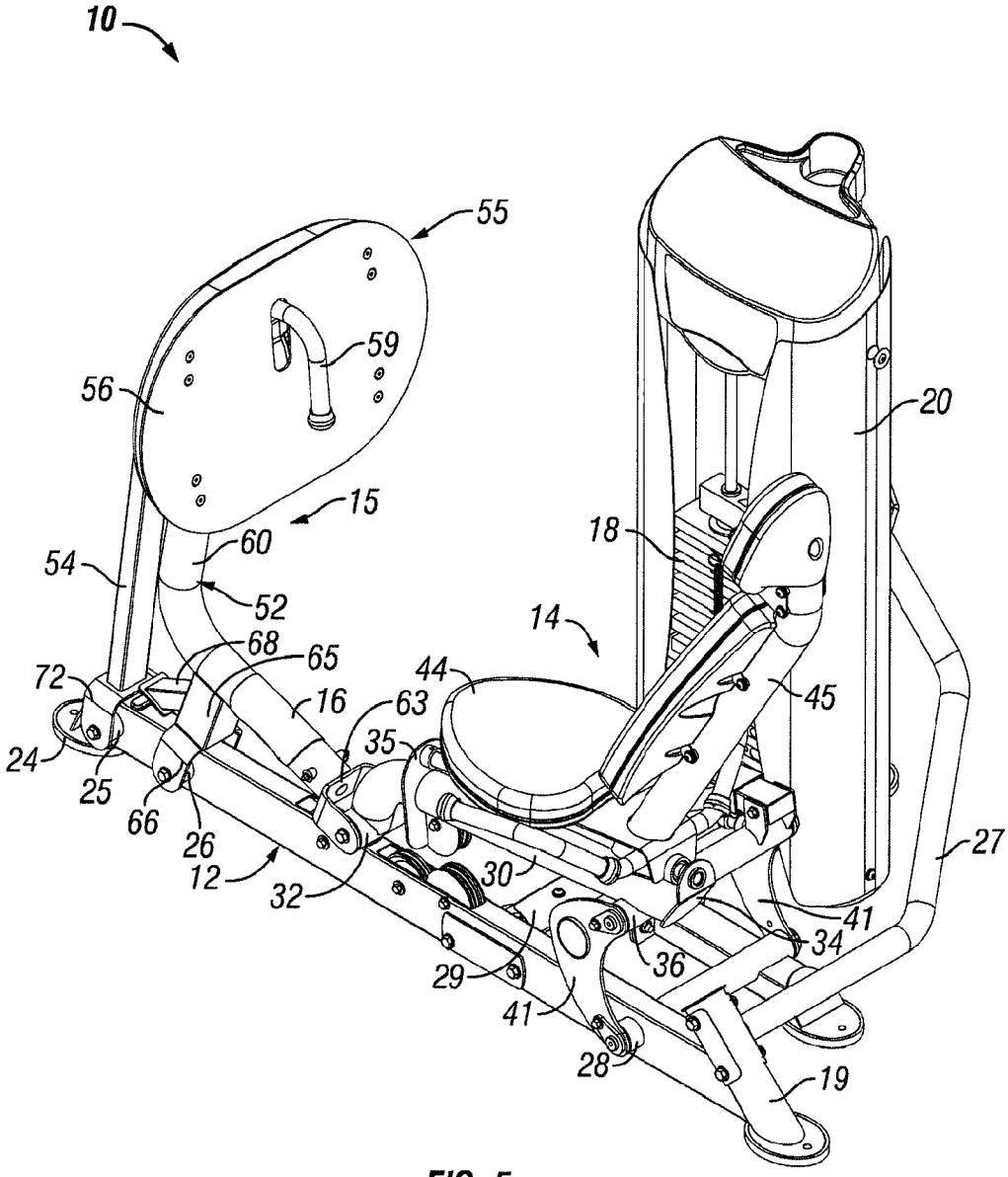
FIG. 5 is a rear perspective view of the machine of FIGS. 1 to 4.

The main frame 12 comprises a horizontal base 22 with floor engaging feet 24 mounted at each end. Three pivot mounts or sleeves 25, 26, 28 are located along the length of the base between its ends, as illustrated in FIGS. 4 and 5. The base 22 is connected to the weight stack housing 20 by cross strut 27, as illustrated in FIGS. 3 and 5. A second, tubular cross strut 29 carries part of the pulley and cable linkage connecting weight stack 18 to the connecting link 16, as described in more detail below. An inclined stop post 19 extends upwardly from the rear end of base 22 for supporting the rear end of the user support assembly in the exercise start position of FIG. 1.

The user support assembly 14 has an "L" shaped base 30 with a first pivot mount or sleeve 32 (FIGS. 4 and 5) approximate its first, downward bending end and a first mounting plate 34 at its second end. A second mounting plate 35 is positioned between the first and second ends of base 30, with a second pivot mount or sleeve 36 located between mounting plates 34, 35 (see FIG. 5). A shaft 38 mounted between mounting plates 34 and 35 is positioned on top of the base 30. In this embodiment, a generally L-shaped user support frame 40 has a base portion 43 on which a primary support comprising a seat pad 44 is mounted, and a generally rearward reclined, upright member 45 extends from a rear end of the base portion. A back pad 46 (secondary support) and head pad 48 are attached to a forward side of the upright member 45. A pair of handles 50 (stabilizing support) are attached to a lower portion of member 45 to project on opposite sides of the seat.

Figure 2:
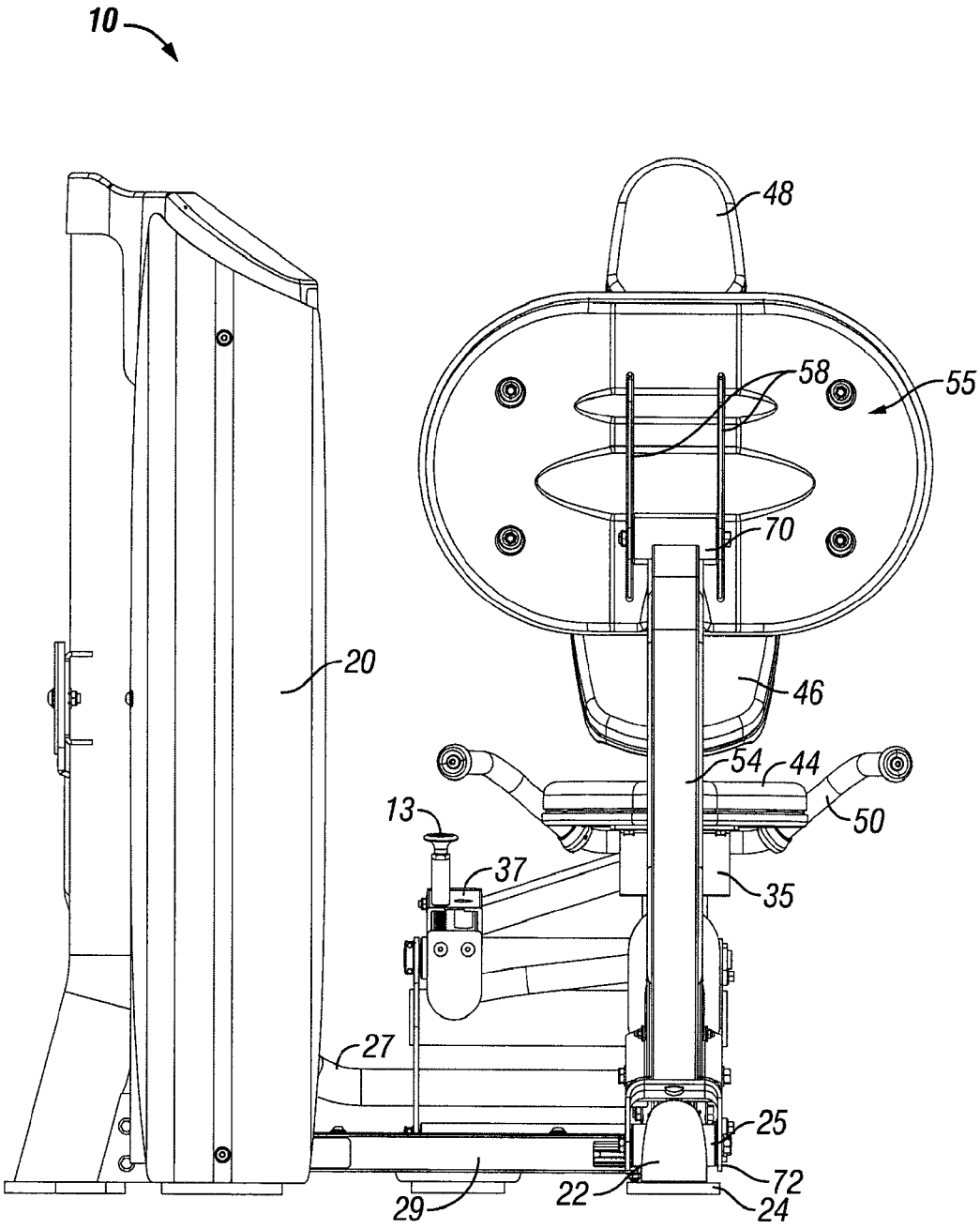
FIG. 2 is a front view of the machine of FIG. 1.

A carriage or bearing sleeve 42 on the lower side of the base portion 43 of the user support frame 40 is slidably engaged with the shaft 38 above base 30 to allow the seat position to be adjusted, as best illustrated in FIG. 1. In this embodiment, sleeve 42 is connected via a cross strut to an adjuster tube 37 to one side of the seat, as illustrated in FIGS. 2, 3 and 4, and the adjuster tube 37 is slidably mounted on receiving tube 39 secured to the user support base 30. Receiving tube 39 has a series of openings and a retractable pull pin 13 on adjuster tube 37 engages in an aligned opening in tube 39 in order to lock the seat in the desired position. In alternative embodiments, alternative mechanisms may be provided to lock the seat in an adjusted position, such as a pull pin on carriage or sleeve 42 engaging in an aligned opening on shaft 38. However, the illustrated arrangement is clearly visible to a user for ease of adjustment when seated on seat pad 44. The sliding connection between the user support frame 40 and the user support base 30 allows adjustment of the distance of the exercise arm assembly 15 from the seat (primary and secondary supports) so as to accommodate users of different heights, as described in more detail below in connection with FIGS. 12 to 17.

As best illustrated in FIGS. 1, 4 and 5, a pair of generally C-shaped pivot links or plates 41, which each have mounting holes at their opposite ends provide a first pivot link between the user support assembly 14 and the main frame. A first pivot pin extending through pivot mount or sleeve 28 on the main frame base is secured to the mounting holes at the first end of each plate 41 for rotation of pivot mount about pivot axis 93, while a second pivot pin extending through pivot mount or sleeve 36 of the user support base 30 is secured to the second mounting holes at the second ends of the respective plates 41 for rotation of pivot mount 36 about pivot axis 33.

The exercise arm assembly 15 comprises a main upright 52, a secondary upright 54 and a footplate 55. The footplate 55 has a user engaging flat surface 56 with mounting plates 58 protruding from its forward face and a handle 59 protruding from the center of the user engaging surface to aid the user in entering and exiting the user support.

The main upright 52 of the exercise arm assembly is of general "L" shape and has a first, upwardly extending leg 60 and a second leg 16 which also acts as the connecting link, as explained in more detail below. A pivot mount 61 at the upper end of leg 60 is rotatably secured between mounting plates 58 of footplate 55 for rotation about pivot axis 82 by a pivot pin extending between the plates, as best illustrated in FIGS. 1 and 4. The second leg 16 or connecting link is connected to the pivot mount 32 at the end of the user support base 30 via a pivot bracket 63 for rotation about a pivot axis 83. Cable anchor 64 is located on the lower side of leg 16 for connection to a load bearing cable (not illustrated) linked to weight-stack 18. An extension member 65 extends from the lower side of second leg 16 at a location adjacent the L-bend or junction between the first and second legs, and a pivot bracket 66 at the end of member 65 is connected to the pivot mount 26 on the base 22 of the main frame for rotation about pivot axis 86. This arrangement provides a second pivot link between the user support assembly and main frame, as described below. A stop 68 projecting at an angle from the forward face of extension member 65 defines the finish or end position of an exercise, as explained in more detail below. In an alternative embodiment, an extension tube may be telescopically mounted in the end of second leg 16 to allow length adjustment of the connecting link.

As illustrated in FIG. 4, the secondary upright 54 has a pivot mount 70 located at its upper end which is rotatably secured between the mounting plates 58 on footplate 55 for rotation about pivot axis 84. A pivot bracket 72 at the lower end of secondary upright 54 is pivotally attached to the pivot mount 25 at the forward end of the frame base 22 for rotation about pivot axis 71.

Assembled, the main frame base 22 has the pivot bracket 72 of the secondary upright connecting to its first, forward pivot mount 25 for rotation about pivot axis 71; the pivot bracket 66 on the extension member 65 of the main upright connecting to its second pivot mount 26 for rotation about pivot axis 86; and the lower end of the user support pivot link 41 connecting to its third, rearward pivot mount 28 for rotation about pivot axis 93. The footplate assembly is connected to the pivot mounts 61 and 70 on the main and secondary uprights for rotation about pivot axes 82 and 84, respectively. The pivoting connection between the main frame, footplate, main and secondary uprights forms a four-bar linkage which uses the main upright to dictate the forward movement of the footplate and the secondary upright to control the angular orientation of the footplate. During the forward motion, the angle of user engaging face of the footplate is constantly adjusted by the secondary upright to match the pivoting motion of the user's ankle.

A cable and pulley system extends from the weight stack 18 through guide tube 29 and connects the base 30 of the user support with the weight stack at pulley 74 to provide resistance to movement by the user support, as seen in FIG. 1. The load bearing cable (not illustrated) extends from pulley 74 around additional pulleys on the main frame base 22 before terminating at anchor 64 on the second leg 16 of the exercise arm main upright. The weight stack may alternatively be linked to the exercise arm or user support assembly alone in other embodiments.

FIGS. 6 to 11 illustrate the exercise movement of machine 10 in more detail. FIGS. 6A and 9A are side views of the machine 10 in the start position for a leg press exercise, and FIGS. 6B and 9B illustrate the exercise finish position, with FIGS. 9A and 9B illustrating a user 75 seated on the machine in the exercise start and finish positions. To perform the exercise, user 75 sits on the seat pad 44, with their back against the back pad 46 and grabs the stabilizing hand grips 50. They then place their feet 76 on the foot engaging surface 56 of footplate 55 of the exercise arm, as illustrated in FIG. 9A. In the start position of FIG. 9A, the user's feet are positioned on the exercise arm footplate, with their knees positioned over their toes. Their upper and lower legs are bent at approximately 90 degrees, placing their thighs parallel to the position of their feet on the footplate. This position duplicates the compressed (lowest) position of a free weight squat. The bold circle with cross hairs highlights the joint or pivot point 78 of the user's hip.

The user then pushes the footplate 55 forward with their feet. This moves the connecting link 16 on the main upright 52 of the exercise arm, due to its pivotal linkage to the footplate, which in turn forces the user support to rotate about its pivotal connections to the main frame until the end position for the exercise is reached, as illustrated in FIG. 9B. This creates a composite motion pivoting action that pulls the user support assembly forward while it lifts and tilts the user support assembly in a rearward direction. As seen in FIGS. 6B and 9B, the stop 68 contacts the main frame base 22 in the finish position.

Figure 9A:
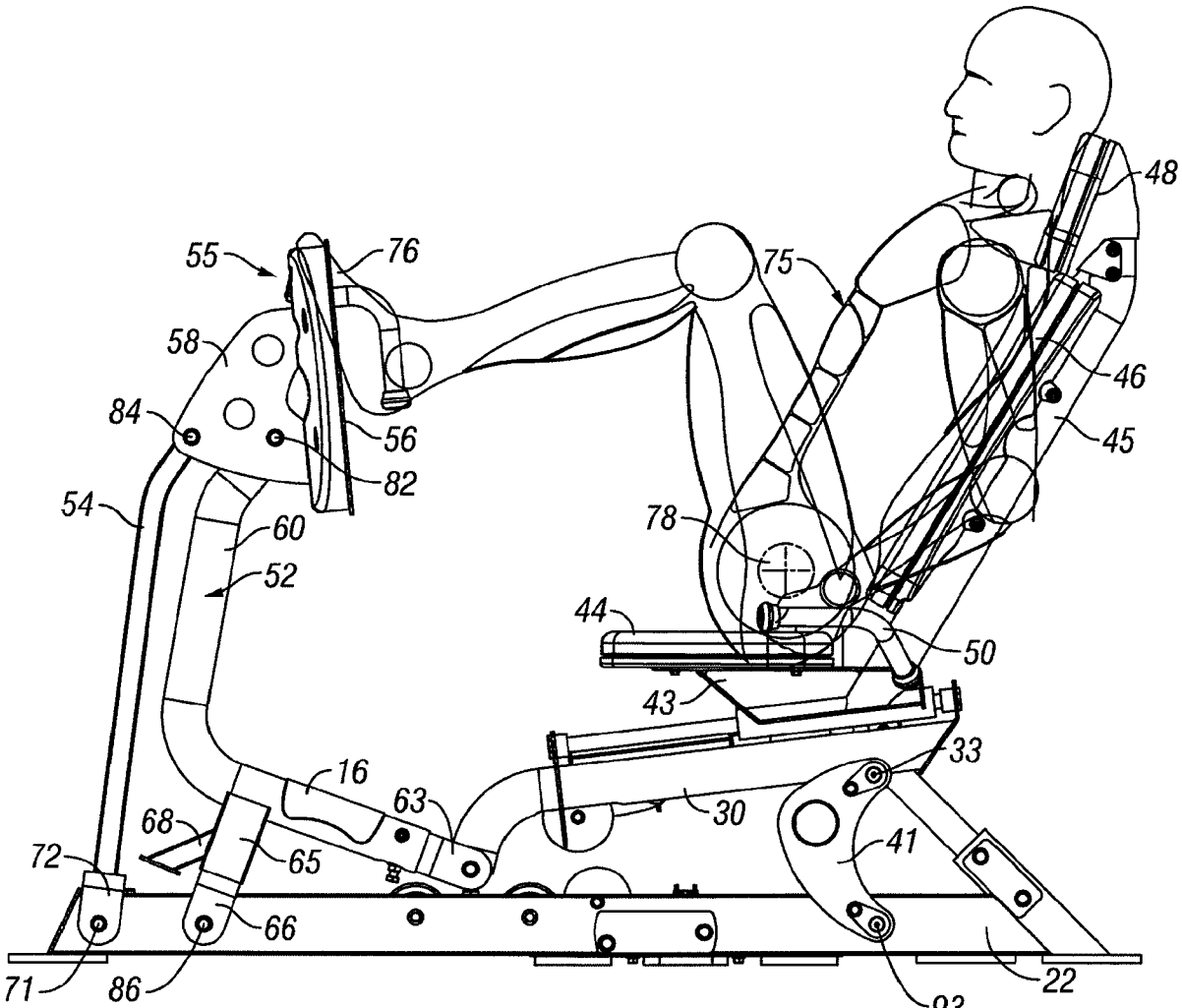
FIG. 9A illustrates a user seated on the exercise machine of FIGS. 1 to 8 in a start position for a leg press exercise.
Figure 9B:
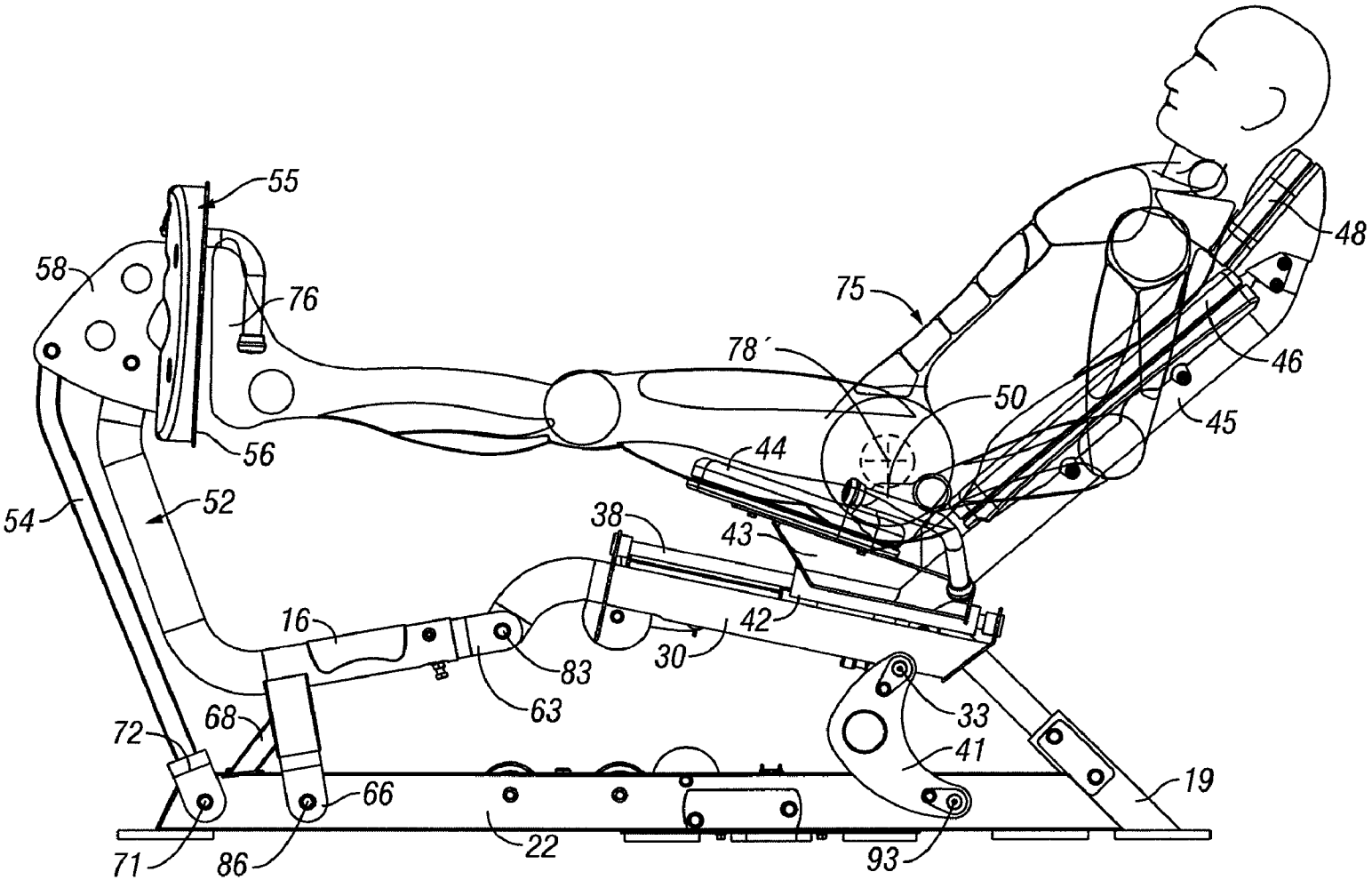
FIG. 9B is a similar view to FIG. 9A, illustrating the user in the end position of the leg press exercise.

In the start position of FIG. 9A, the user is placed in a back supported starting position with their feet, knees and hips in the proper alignment. During the exercise movement, the user support and exercise arm assemblies move together to adjust that position, following the natural pivoting movement of the ankles, knees and hips as the users legs straighten, replicating the motion of a barbell squat. As the exercise arm assembly is moved forward, the connection between the exercise arm assembly and the user support assembly creates movement in the user support, changing the user support orientation by forcing the user support pivot to rotate about its connections to both the user support assembly and the main frame. FIG. 9B shows the user in the finish position, with their legs straightened, and their hips positioned over their ankles as if they were standing upright. This position places the user is a safe, supported position that eliminates or reduces stress to the low back by removing or reducing its involvement in the exercise. This motion takes the resistive force from the footplate and transfers it straight to the user hips, forcing their low back against the back pad 46 (secondary support) and keeping them firmly planted in the seat 44 (primary support). The dashed circle 78' highlights the user's hip joint in this position.

Figure 8:
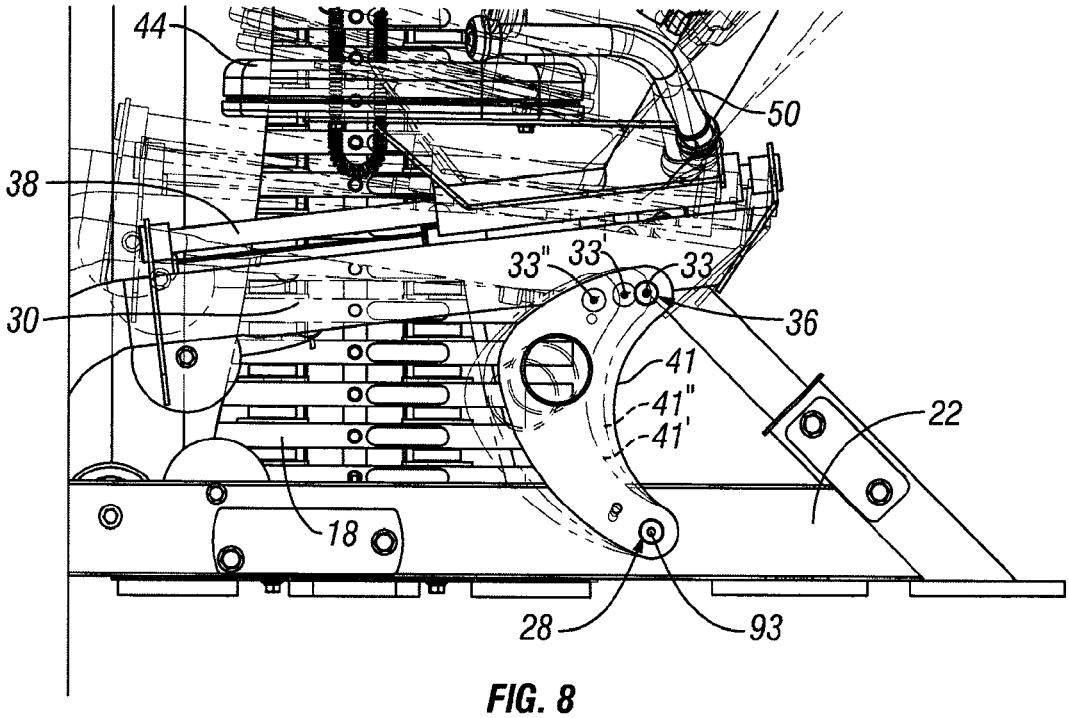
FIG. 8 is a close up, enlarged view of the user support pivot of the exercise machine of FIGS. 1 to 7 in a start, mid-range, and end position of a leg press exercise.

FIGS. 7A to 7D show a sequential progression of the exercise movement. They show the user support tilting rearward as it is pulled forward by the movement of the exercise arm. It also shows the user support pivot link or plate 41 rotating forward about pivot axis 93 at its pivotal connection to the main frame at pivot mount 28. This sequence shows how much the pivot rotates forward as the user support 14 rotates rearward at approximately 3 degree increments. In each figure, the bold lines represent the position of the machine at the start of the sequence with the dashed lines representing the position of the machine at the end of the sequence. The sequence from FIGS. 7A to 7D shows that the user support moves forward and upward as it reclines a seated user rearward. FIG. 8 is a close up of the user support pivot plate in a start (41), mid-range (41') and finish (41") position of the exercise movement. It can be seen that the user support pivot 36 at the upper end of the pivot link plates 41 is shifted forward between the start position 33 and the end position 33". At the same time, the forward end of the user support base 30 is pivoted upward due to its connection to the connecting or pivot link or second leg 16 of the exercise arm main upright, tilting the user rearward as their body is shifted forward.

Figure 6A:
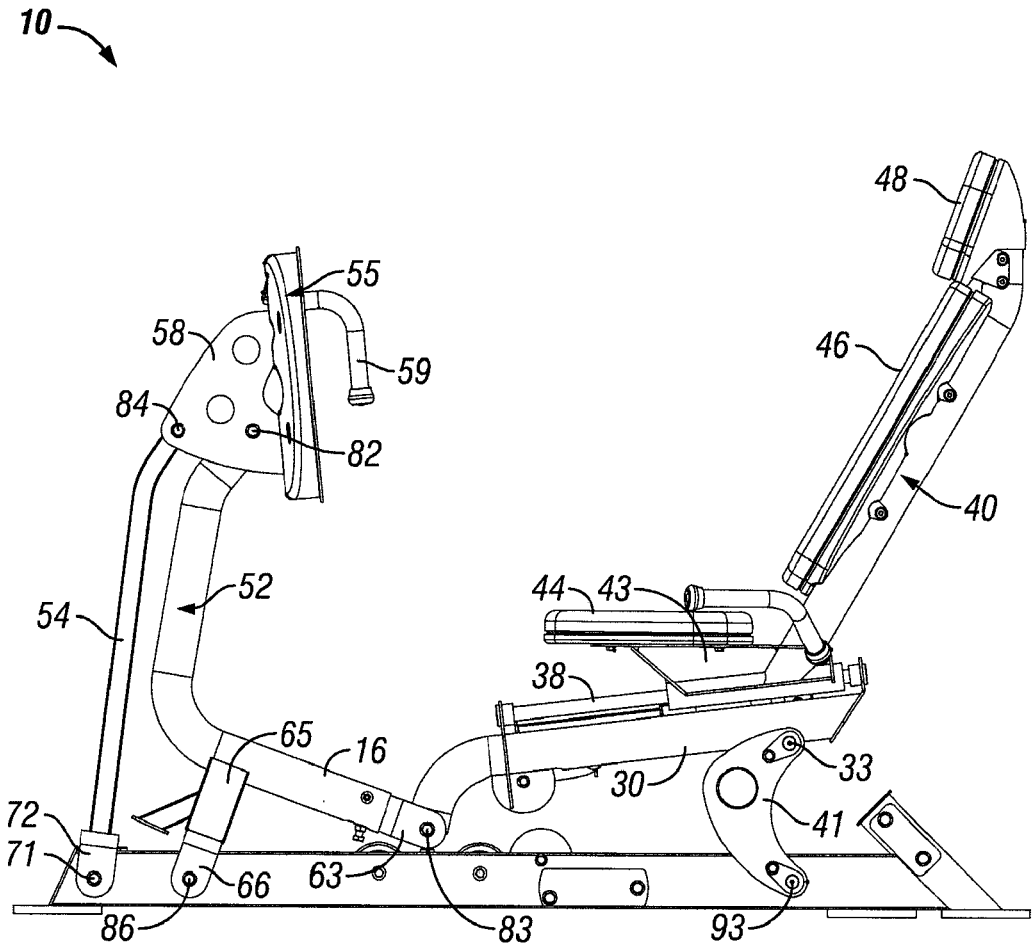
FIG. 6A is a side elevation view of the machine of FIGS. 1 to 5 in a start position for a leg press exercise.
Figure 6B:
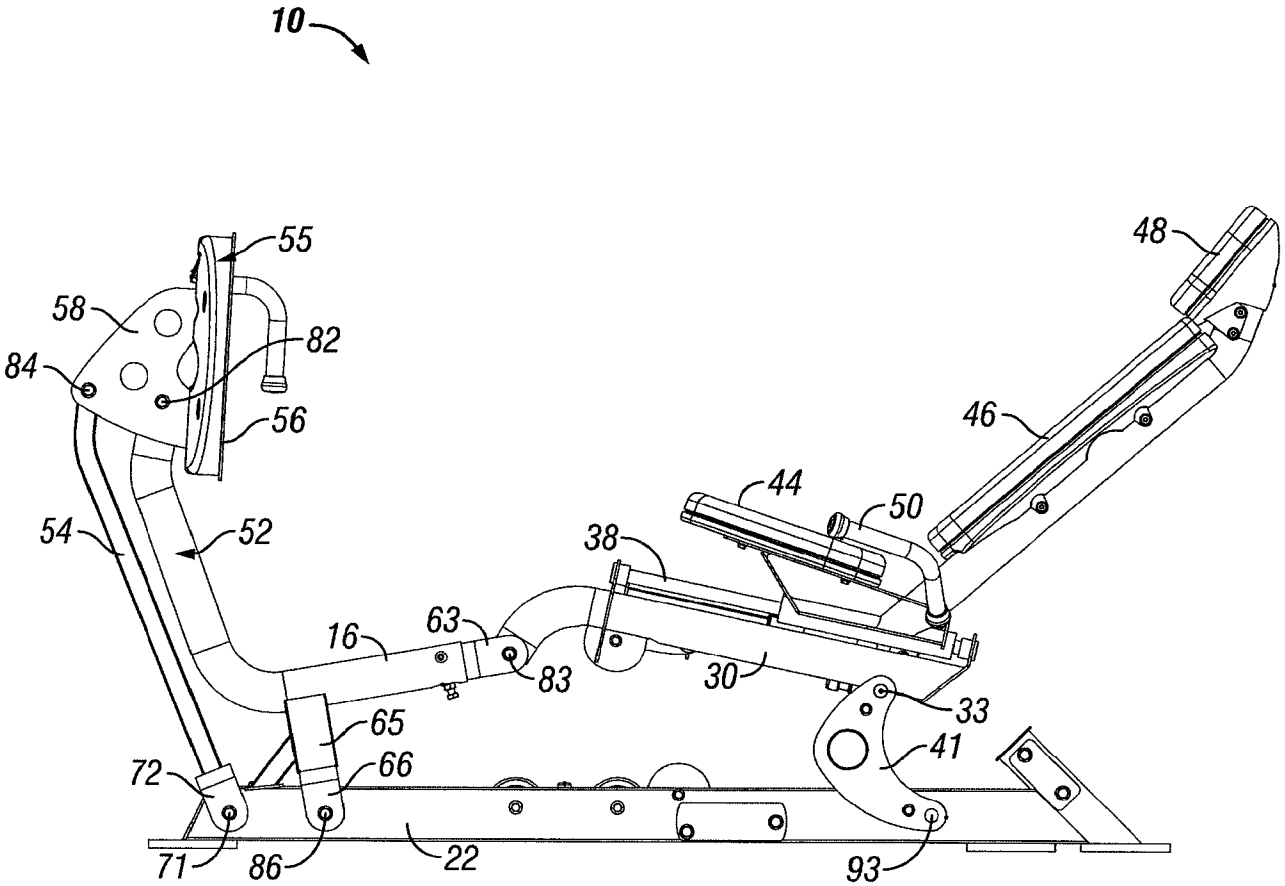
FIG. 6B is a side elevation view similar to FIG. 6A illustrating the machine in an exercise end position.
Figure 7A:
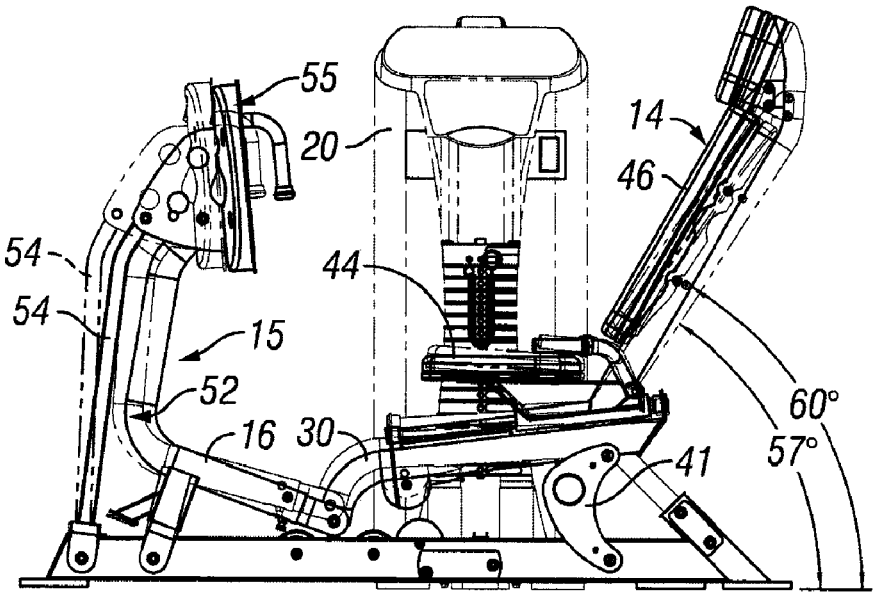
FIGS. 7A to 7D are side elevation views illustrating the sequential progression of an exercise movement from the start to the end position.
Figure 7B:
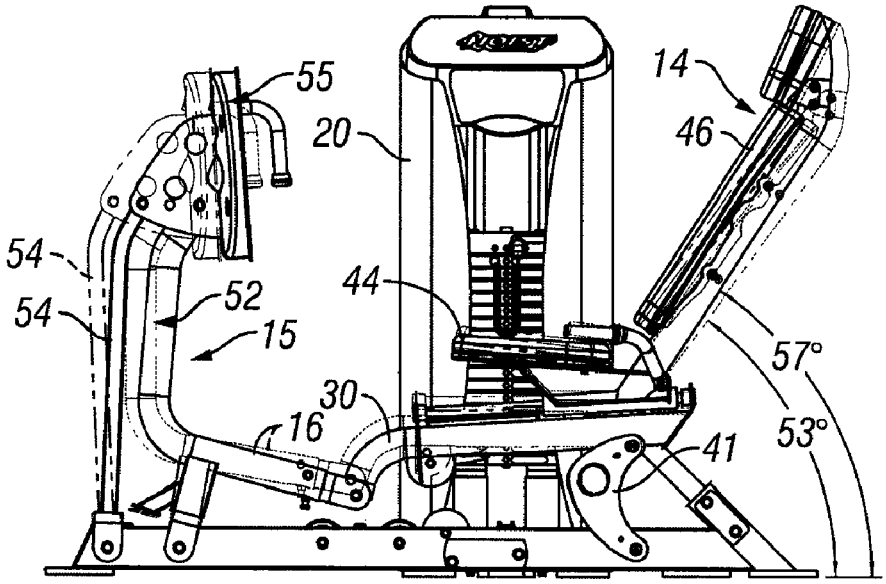
Figure 7C:
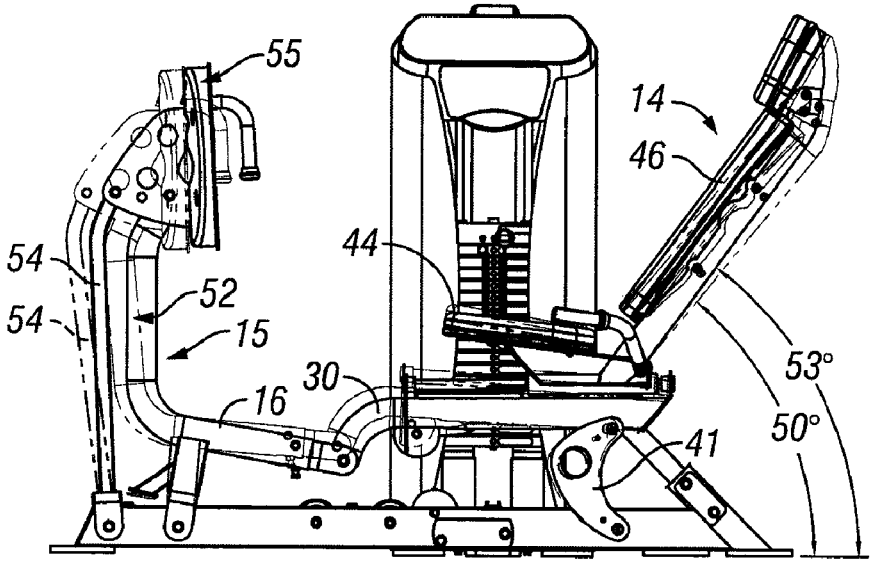
Figure 7D:
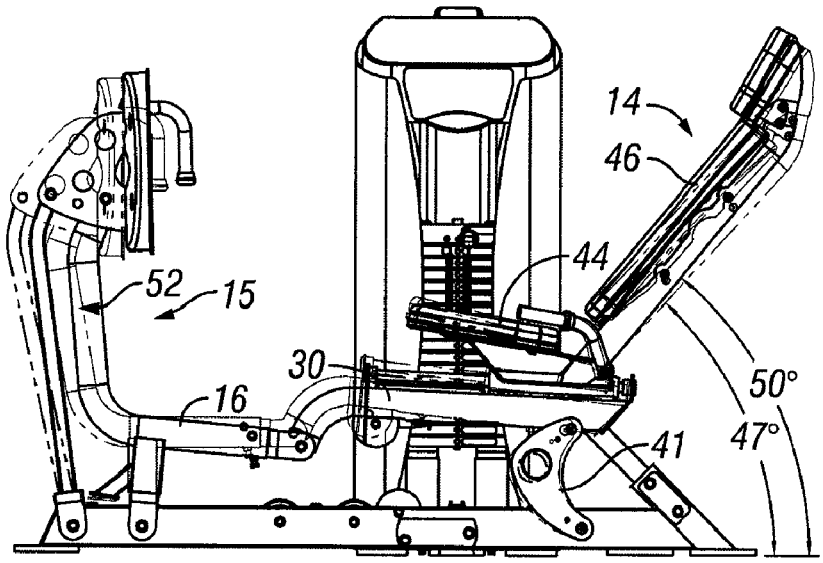
Figure 10:
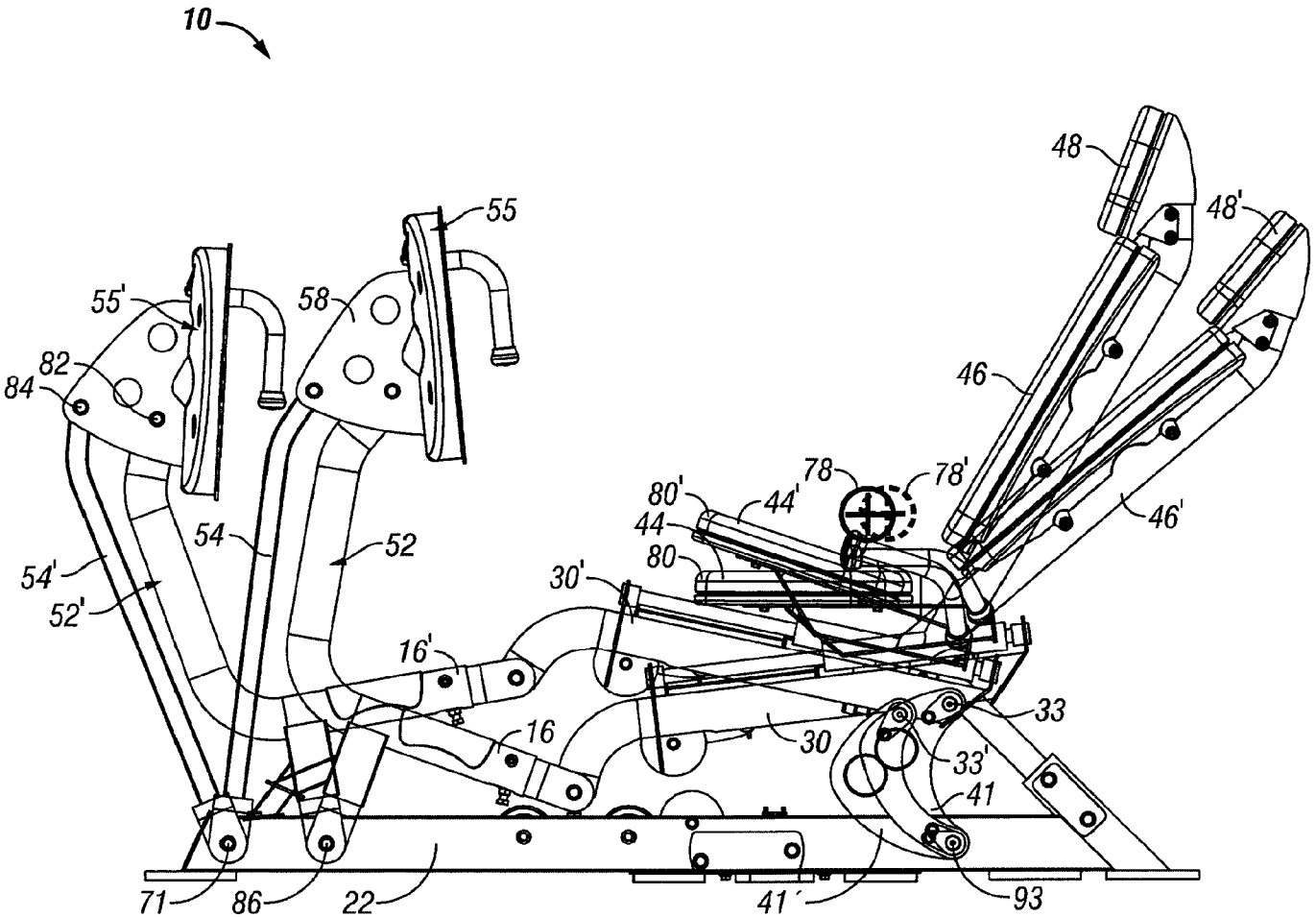
FIG. 10 is an overlay of two side views of the exercise machine of FIGS. 1 to 9 in the start and end positions of FIGS. 9A and 9B, also showing the positions of the user's hip joint in these exercise positions.

FIG. 10 is an overlay of machine in the start and finish positions of FIGS. 6A and 6*b*, with the two highlighted user hip joint positions 78, 78' of FIGS. 9A and 9B. This shows that the two hip positions are inline at the same elevation with the start position (bold) slightly forward of the finish (dashed). FIG. 10 also illustrates how the nose or front edge 80, 80' of the seat (primary support) is in the same horizontal orientation with the finish position 80' being directly above the start position 80. As illustrated, the user support travels forward, and the user support pivot link 41, 41' rotates forward, while the back pad (secondary support) reclines rearward between the exercise start (46) and exercise finish (46') positions. This means that the position of the user actually travels rearward in a straight line movement, while the user support is moving forward, in an upward angle. The relative start and finish positions of the main upright (52, 52'), secondary upright (54, 54') and footplate (55, 55') of the exercise assembly can also be seen in FIG. 10.

Figure 11:
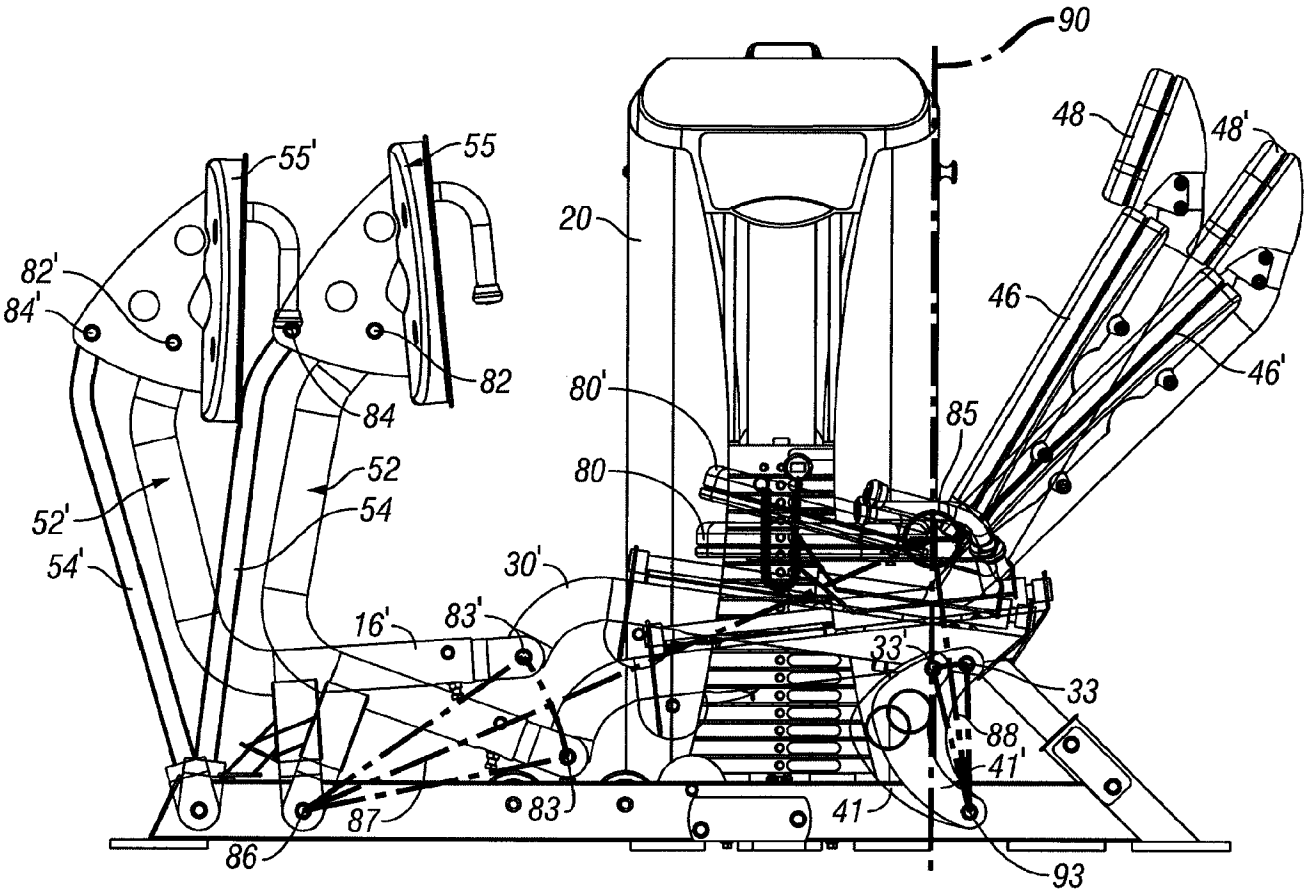
FIG. 11 is another overlay of the exercise start and end positions illustrating the theoretical pivot point of the pivoting action and the centerline of the arcing movement of each linkage bar.

FIG. 11 is a similar overlay of the machine in the start and finish position, with the finish position of each part being indicated by a dash (') next to the relevant reference number, but in this case the pivoting action is highlighted and the theoretical pivot point 85 of the exercise motion is illustrated. Because the second leg or pivot link 16 of the "L" shaped main upright of the exercise arm assembly 15 acts as a connecting link between the pivotal connection of the upright to the main frame at pivot axis 86 and to the user support base 30 at pivot axis 83, the combination of this second leg 16, main frame base 22, user support base 30 and user support pivot link or plate 41 forms a four-bar linkage. The four-bar pivot linkage supporting the user support assembly comprises first pivot link or plate 41 beneath the user support frame, and a second pivot link in front of the user support comprising part of the second leg 16 of the exercise arm main upright and the downward extension 65. Leg 16 and extension 65 form a link which is pivotally connected between the forward end of the user support frame and the main frame.

By using the four-bar linkage as the user support pivot system, all the pivoting action can take place under the user with the pivot mounts conveniently located on the main frame and user support. However, the theoretical pivot of the user support, i.e., the pivot point about which the user support rotates, is actually located elsewhere. FIG. 11 illustrates the centerline 87 of the arcing movement of the pivot linkage between the forward end of connecting link 16 and the main frame base 22, and the centerline 88 of the arcing movement of the pivot link 41 between the user support and main frame base 22. The point in space where the two centerlines 87, 88 meet forms the theoretical pivot 85, i.e., the point where a single pivot would have to be located in order to mimic the same user support movement pattern achieved by the four-bar linkage. The dotted vertical line 90 bisecting this pivot point represents the gravitational centerline for the user support movement. In this embodiment, the position of the user support pivot results in the combined weight of the user and user support being distributed on both sides of gravitational centerline 90 of the user support pivotal motion. This balanced weight distribution results in a portion of the user and user support being positioned on each side of the gravitational centerline in both the start and finish positions. As the exercise arm is moved, a portion of this combined weight passes through the gravitational centerline, redistributing the weight. This re-distribution is gradual and continuous throughout the exercise motion and is not noticed by the user.

Starting the exercise with a portion of the combined weight of the user and user support on the directional side (side that the user support travels towards) of the gravitational centerline results in the initial lifting resistance being reduced. Finishing the exercise with a portion of the combined weight on the non-directional side prevents or reduces resistance "drop-off" at the end of the exercise. This balanced distribution of user and user support reduces the effect the combined weight has on the exercise resistance.

The advantage of the four-bar pivot system with the theoretical pivot is that it takes the movement pattern of a single point pivot that might normally be located in an area impossible to access due to either structural or user interference and makes it possible. Without this system, the combined exercise arm and user support movement that produces the composite motion pivotal action of FIGS. 6 to 11 could be very difficult to achieve, or even impossible.

FIGS. 12 to 17 illustrate the machine in the start and end position with the user support adjusted to accommodate users of different heights. In each of these figures, the dashed circle 85 represents the theoretical pivot point of the user support movement with the vertical line 90 representing the gravitational centerline of that movement. These drawings show how a portion of the combined weight of the user and user support is positioned on each side of the gravitational centerline in both the start and finish positions in all three examples. They also show that only a small portion of this combined weight passes through the gravitational centerline. The position of the theoretical pivot 85 in these drawings demonstrates why a single pivot point would interfere with the adjustment capabilities of the user support assembly, while the four-bar linkage does not interfere with this adjustment.

Figure 12:
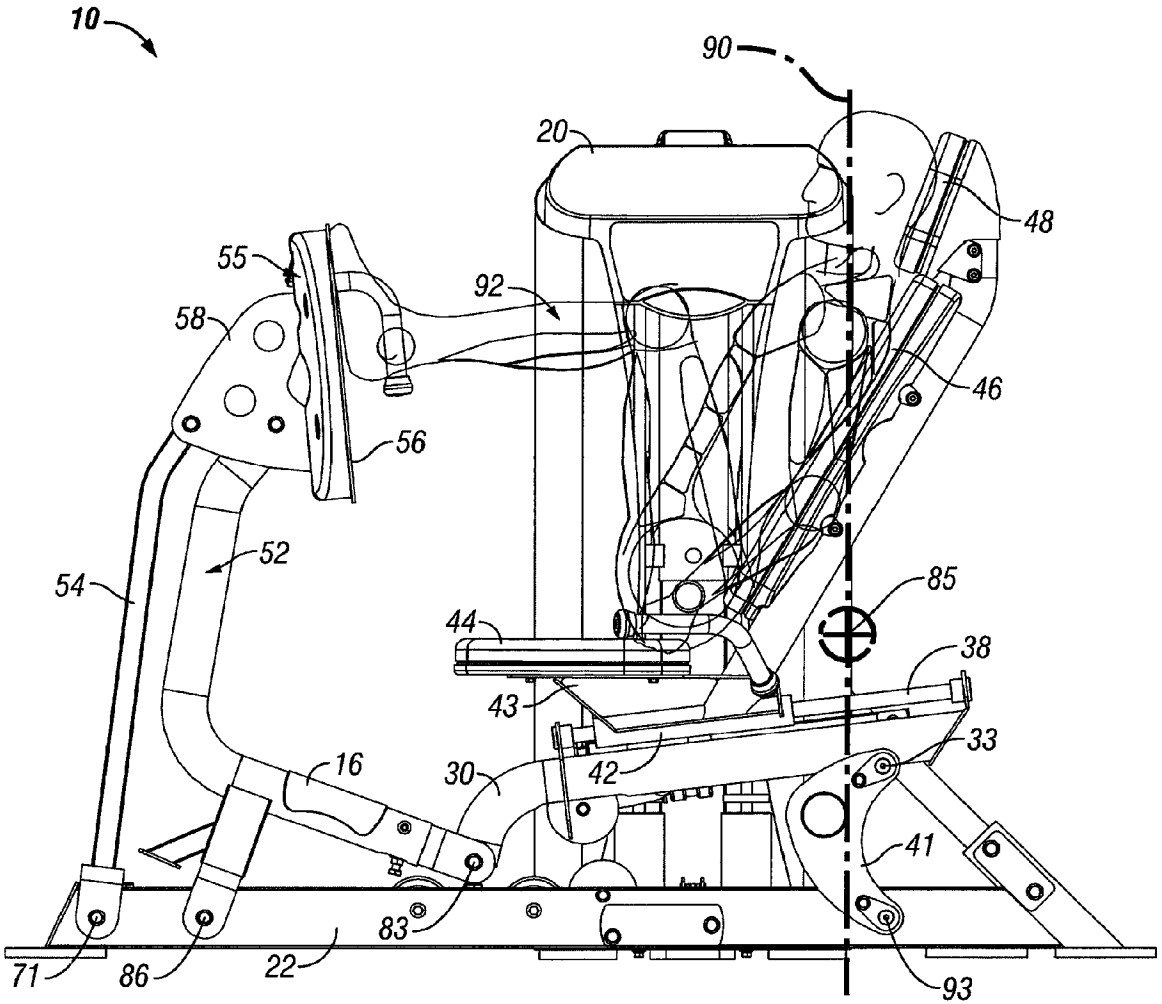
FIG. 12 is a side elevation view of a shorter user seated on the exercise machine of FIGS. 1 to 11 in the exercise start position, with the user support adjusted to accommodate the shorter height user.
Figure 13:
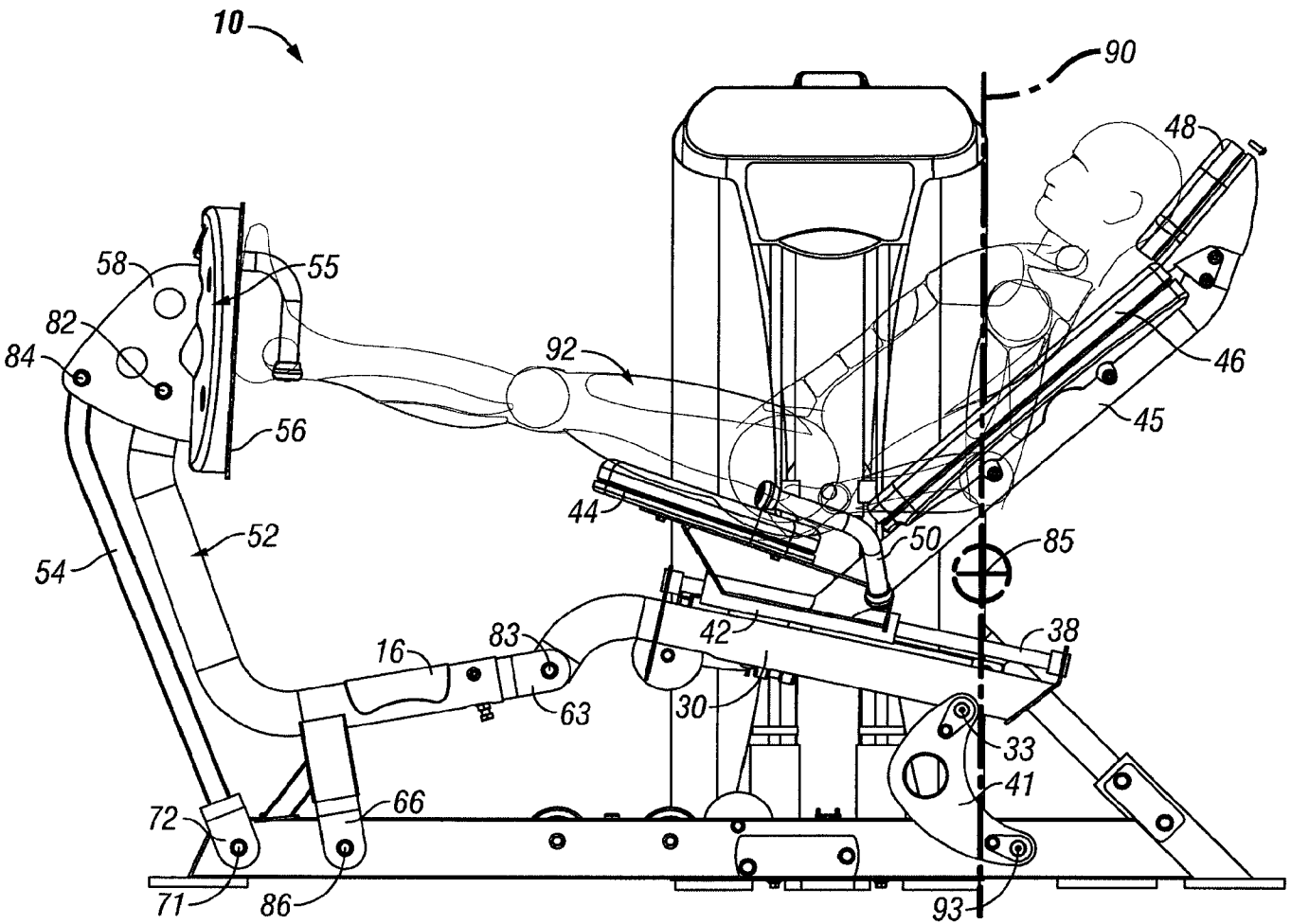
FIG. 13 is a side elevation view similar to FIG. 12 but with the exercise machine in the exercise end position.

FIGS. 12 and 13 illustrate a shorter user 92 in the exercise start and end position, respectively, with the seat 44 positioned in the forward most position on adjuster tube 38. The theoretical pivot 85 is located behind the user position, approximately inline with the top of the primary support pad 44.

Figure 14:
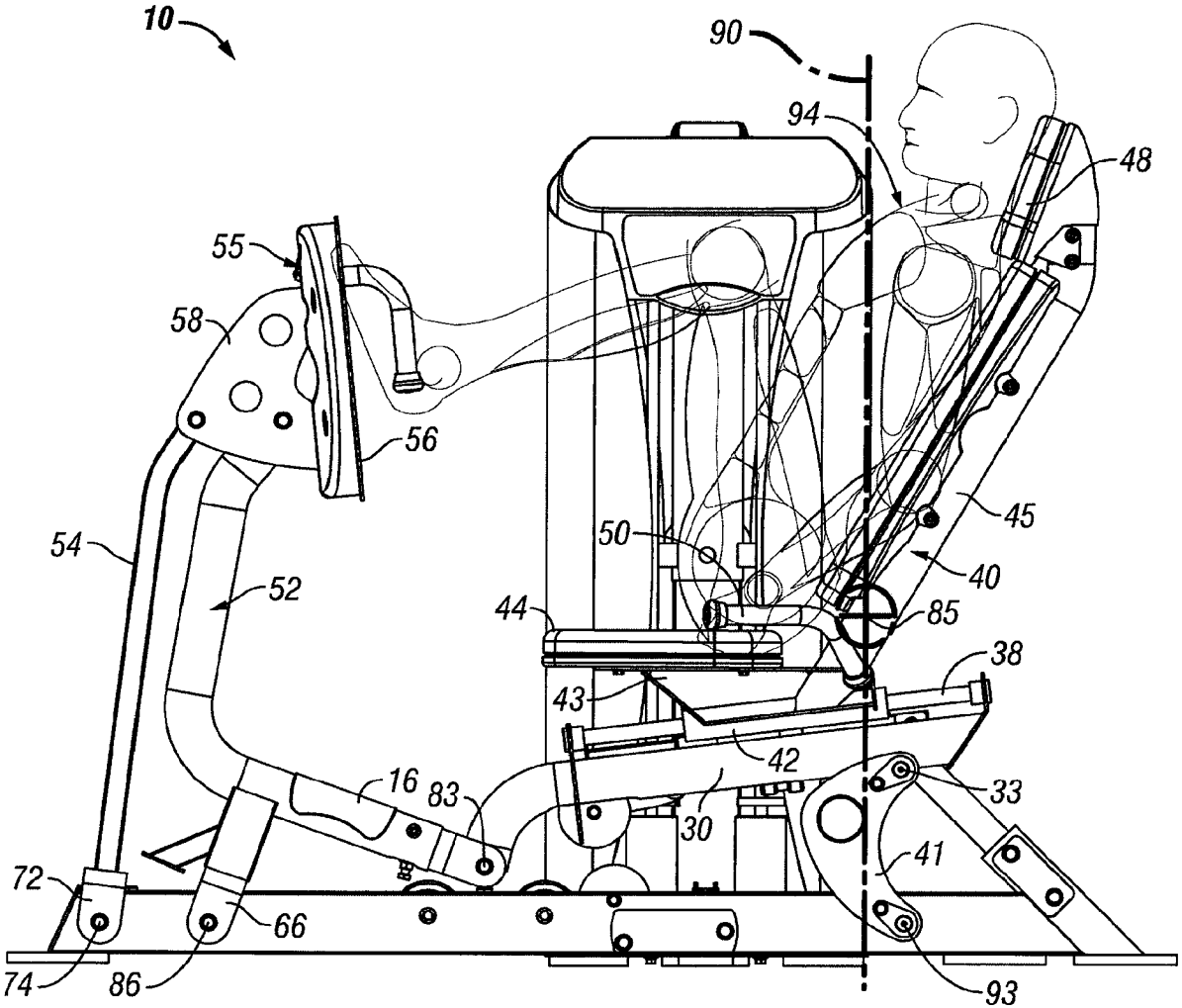
FIG. 14 is a side elevation view of a user of medium height seated on the exercise machine of FIGS. 1 to 11 in the exercise start position, with the user support adjusted from the position of FIGS. 12 and 13 to accommodate the medium height user.
Figure 15:
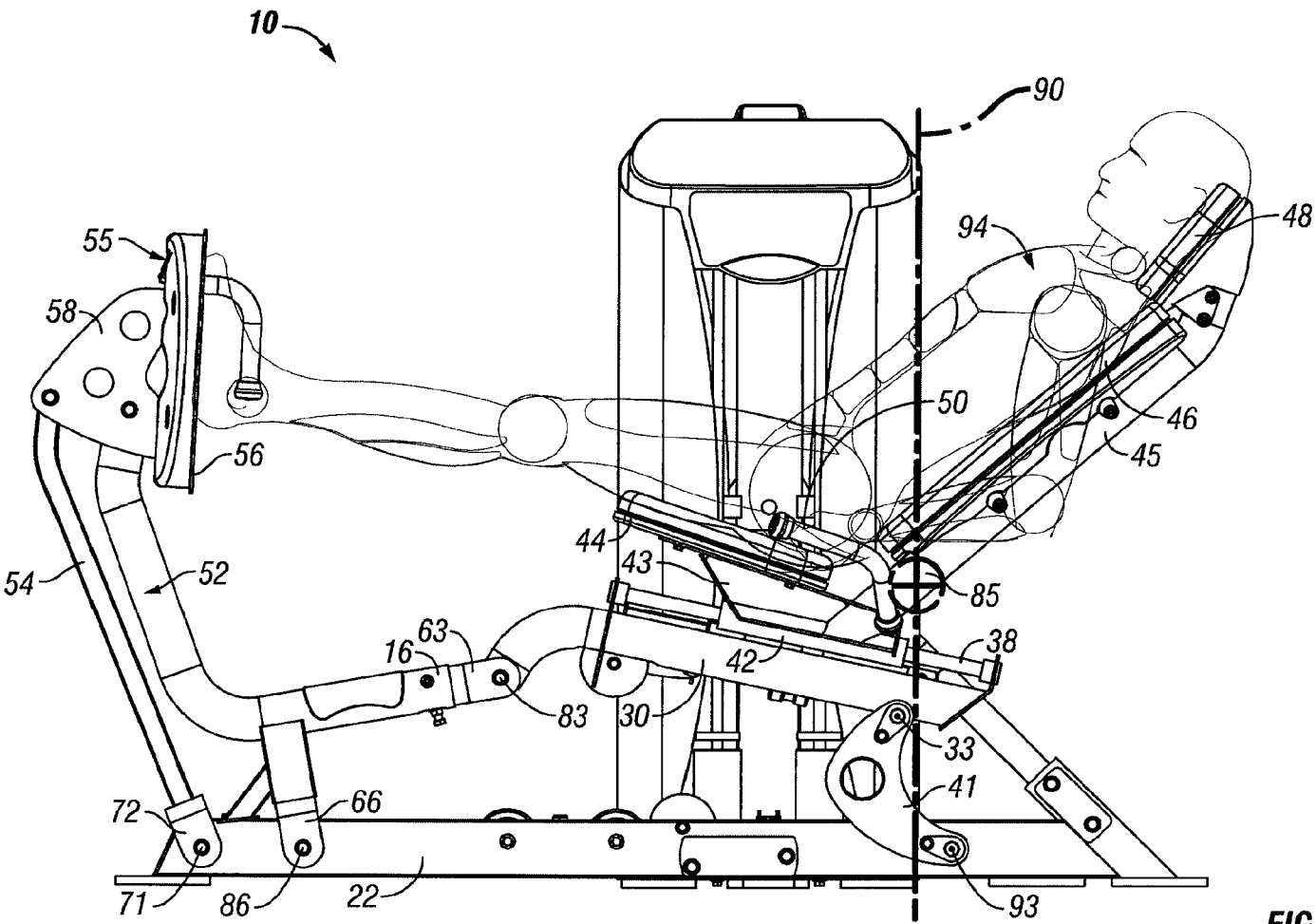
FIG. 15 is a side elevation view similar to FIG. 14 but with the exercise machine in the exercise end position.

FIGS. 14 and 15 illustrate a medium height user 94 in the start and end position, with the seat positioned at an intermediate position on adjuster tube 38. The theoretical pivot 85 in this case is located in the user position at a location slightly below the height of the primary support pad 44. More of the user's weight is located to the rear of the vertical gravitational line 90 at the start and end of the exercise when the seat is adjusted to this position.

Figure 16:
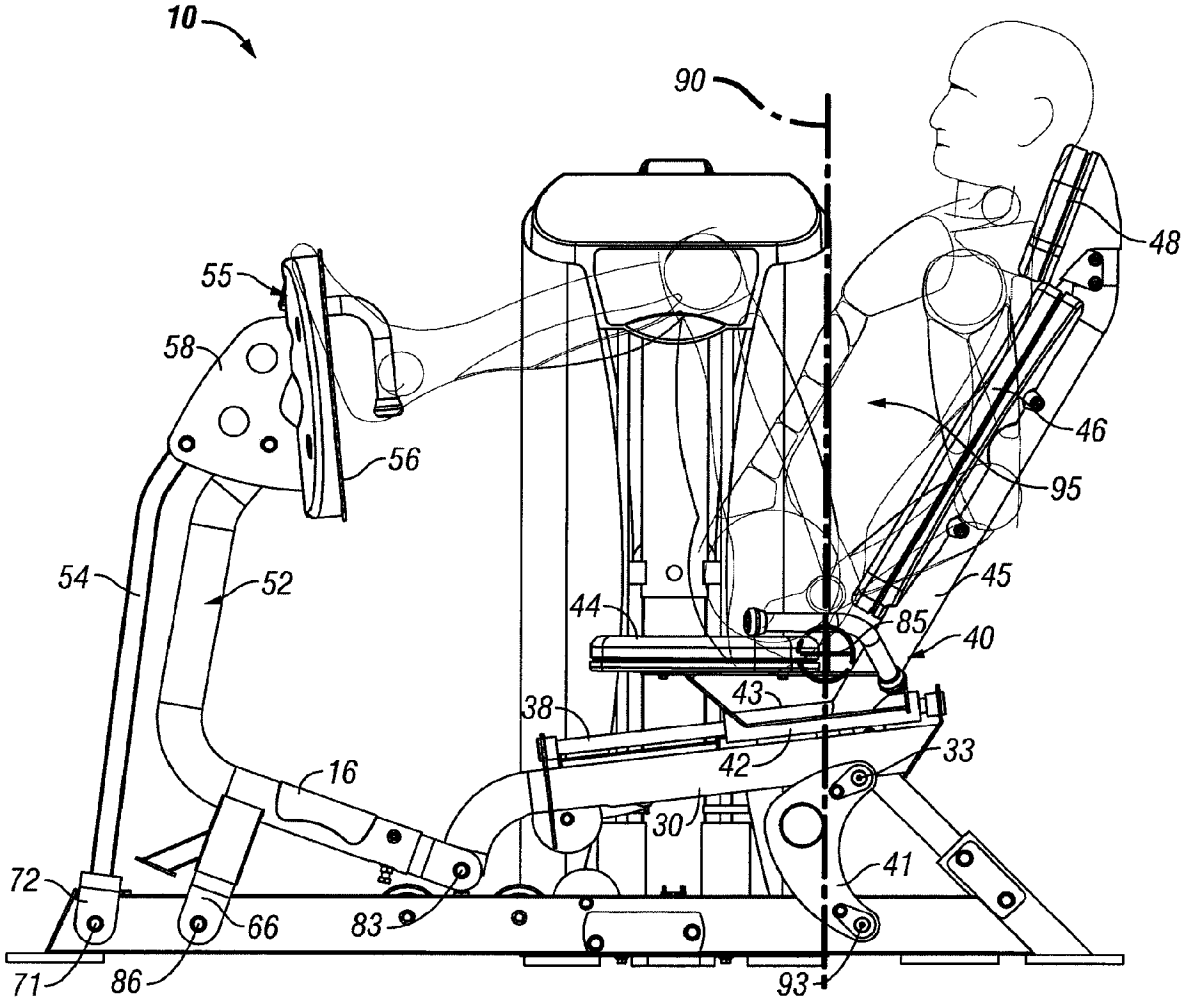
FIG. 16 is a side elevation view of a taller user seated on the exercise machine of FIGS. 1 to 11 with the machine in the exercise start position, with the user support adjusted from the positions of FIGS. 12 to 15 to accommodate the taller user.
Figure 17:
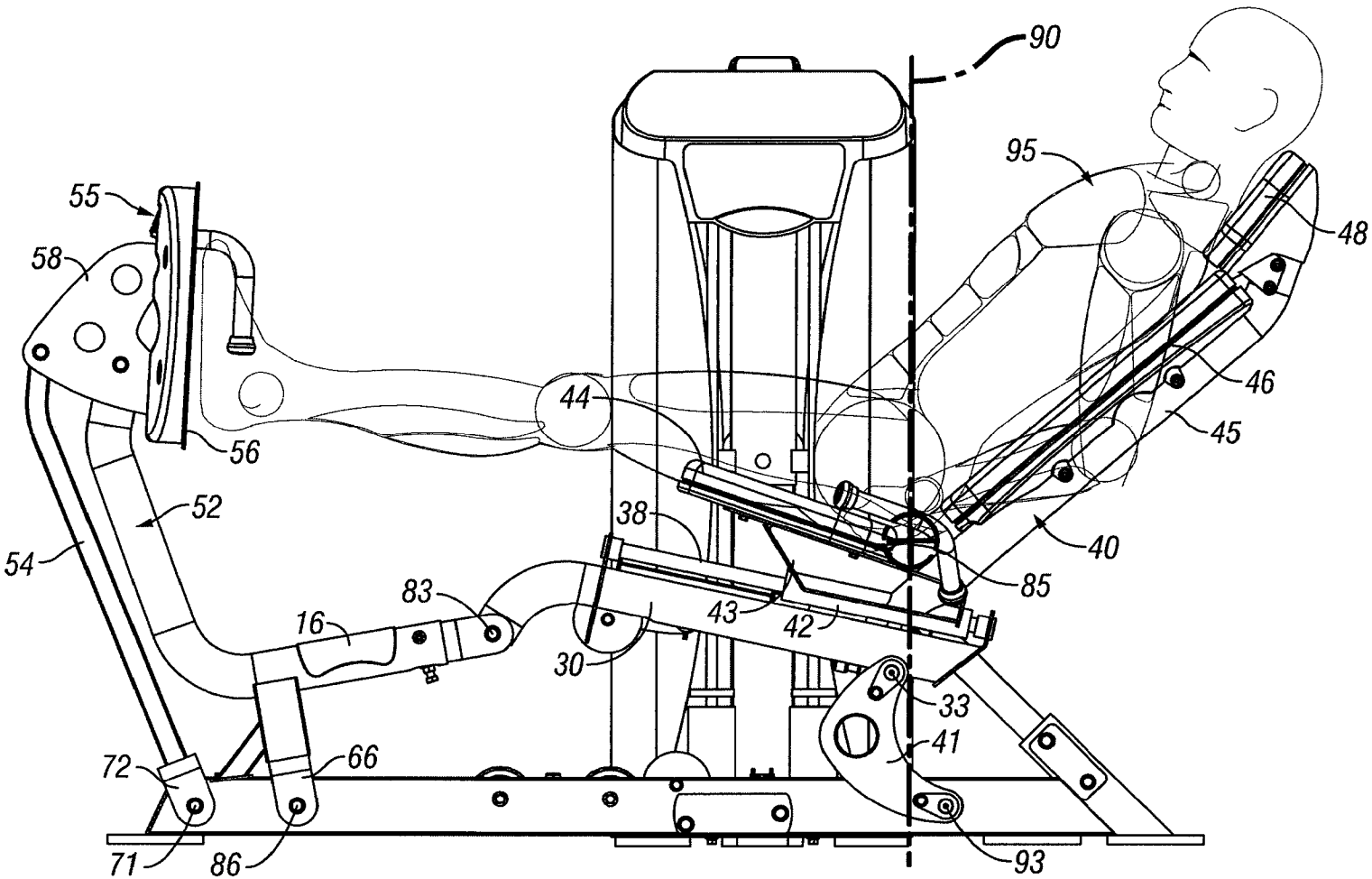
FIG. 17 is a side elevation view similar to FIG. 16 but with the exercise machine in the exercise end position.

FIGS. 16 and 17 illustrate a taller user 95 in the start and end position, with the seat positioned in the rearward most position on adjuster tube 38. The theoretical pivot 85 is located in the user position, below the top of the primary support pad. More of the user's weight is positioned to the rear of the vertical gravitational centerline in this position.

Figure 28:
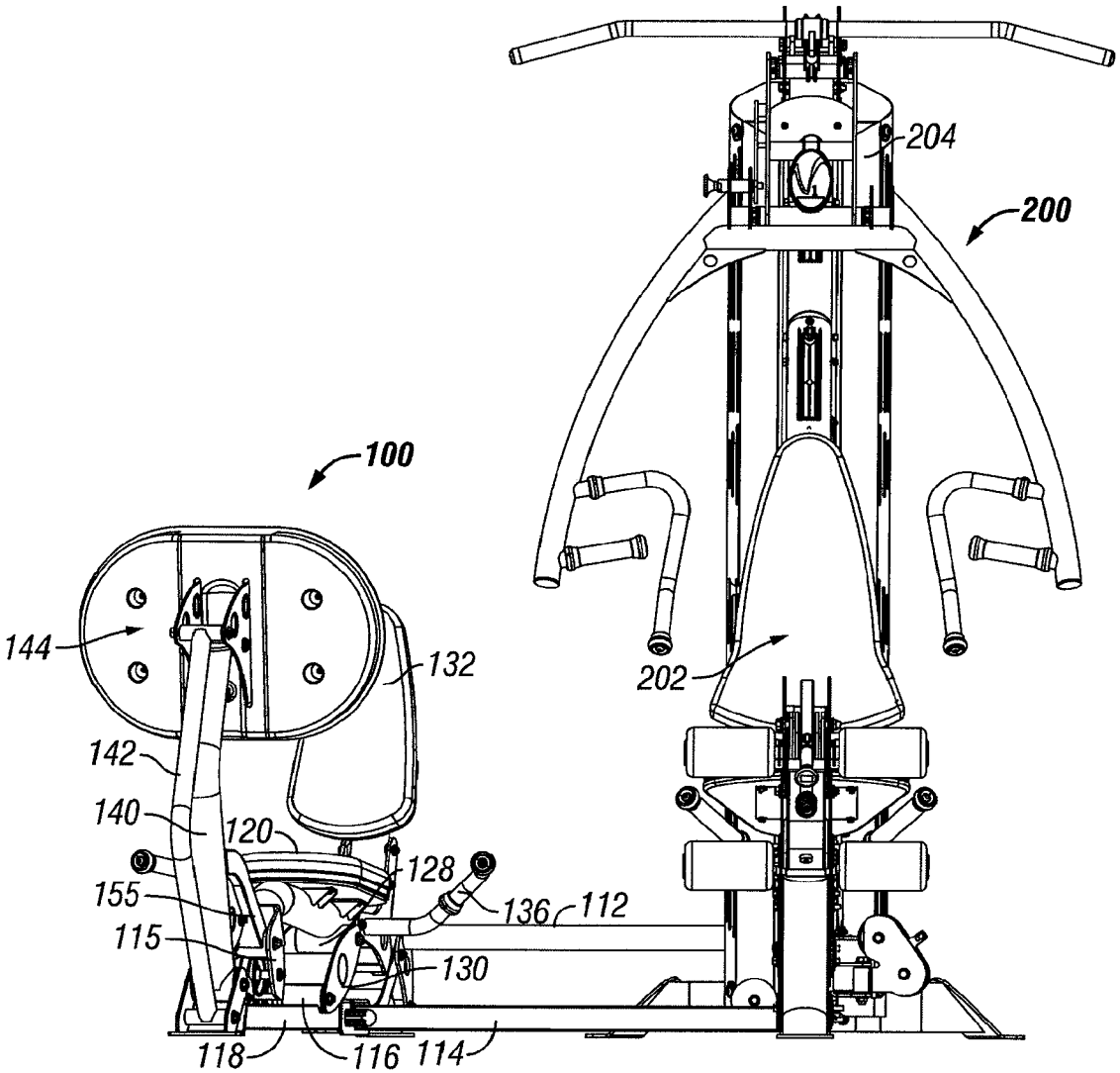
FIG. 28 is a front elevation view of another embodiment in which the leg press machine of FIGS. 18 to 27 is attached as a station of a multi-function home gym.
Figure 29:
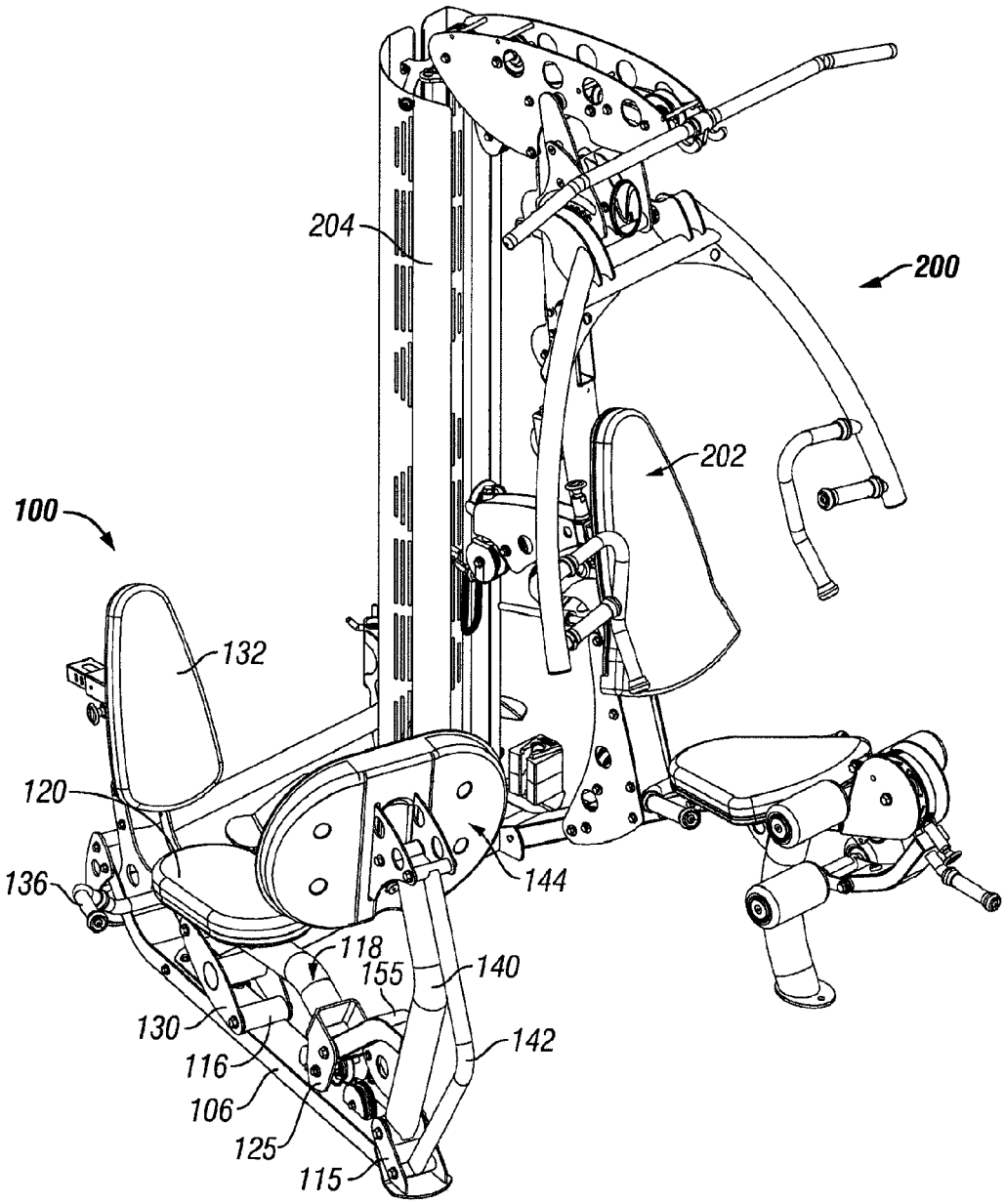
FIG. 29 is a front perspective view of the multi-function home gym of FIG. 28.

FIGS. 18 to 27 illustrate a second embodiment of a leg press exercise machine 100. This embodiment has many elements which are the same or similar to elements of the first embodiment. Although machine 100 may be designed as a self-contained, free-standing machine with its own load or exercise resistance, as is the case with machine 10 of the first embodiment, the machine 100 in the illustrated embodiment is designed as an accessory or exercise station that connects to another piece of equipment, such as a multi-function home gym 200 as illustrated in FIGS. 28 and 29.

Machine 100 is illustrated in an exercise start position in FIGS. 18 to 23, and has a main frame 102, and a user support assembly 104 and exercise arm assembly 105 pivotally supported on the main frame. Main frame 102 comprises a horizontal base 106 with a floor engaging foot 108 mounted at its forward end and an upward bend 110 at its rear end (see FIG. 21). A rear support tube 109 with a floor engaging foot 111 is mounted to the rear end of the horizontal base member. A pair of cross struts 112, 114 extend to one side of the base 106 (see FIGS. 19 and 22) for connecting the main frame of this accessory unit to a self-contained exercise machine as mentioned above. A cable and pulley system, linked to the self-contained unit, extends through cross strut 114 to connect the user support assembly and exercise arm assembly with a load to provide resistance. A forward pivot mounting bracket 115 is attached to the floor engaging foot 108 at the forward end of the base. A pivot mount 116 (FIG. 22) is located on the base 106 of the main frame at a location spaced between the forward and rear ends of the base.

Figure 18:
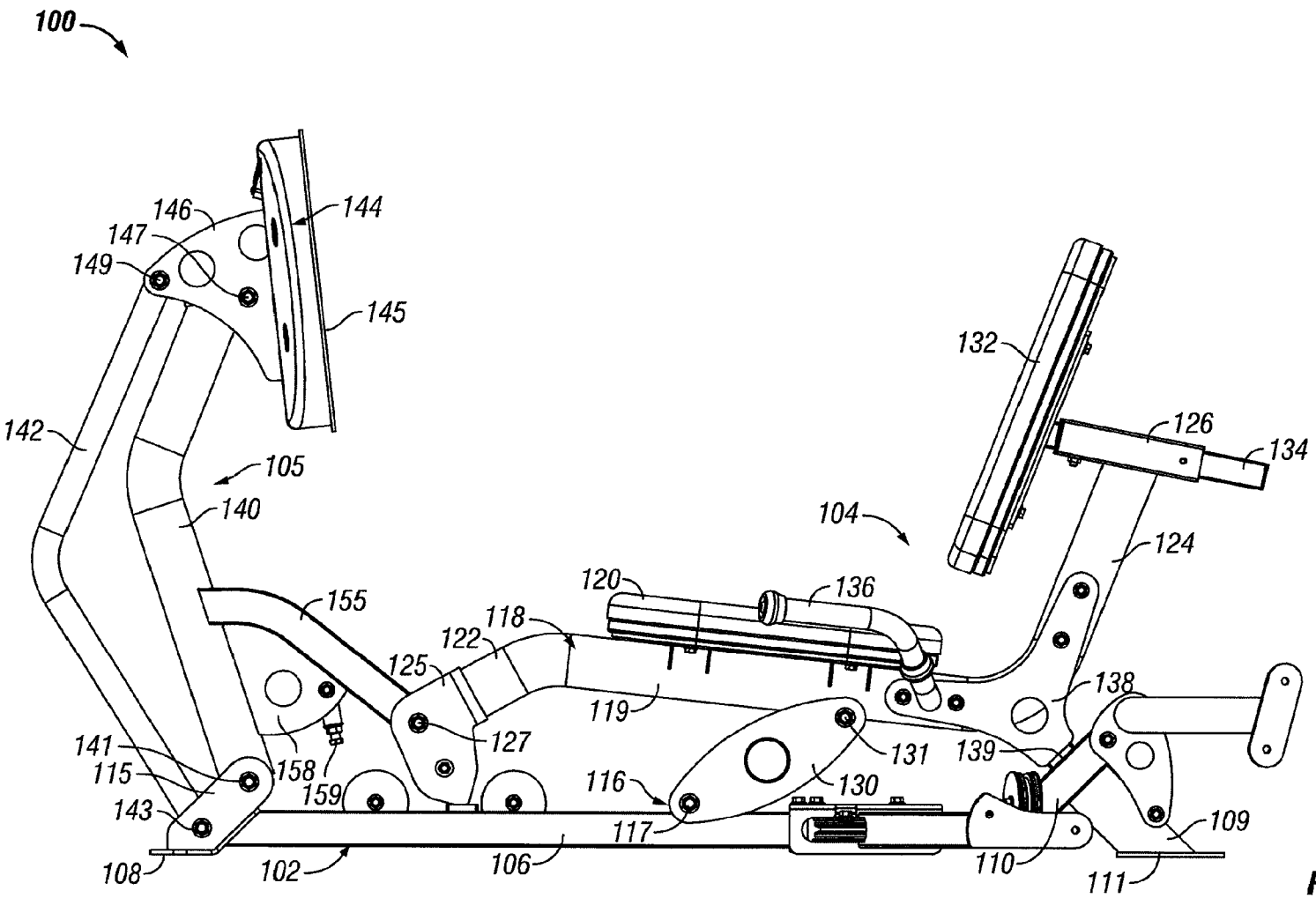
FIG. 18 is a side elevation view of one side of a second embodiment of a leg press exercise machine, with the machine in a start position for performing a leg press exercise.
Figure 19:
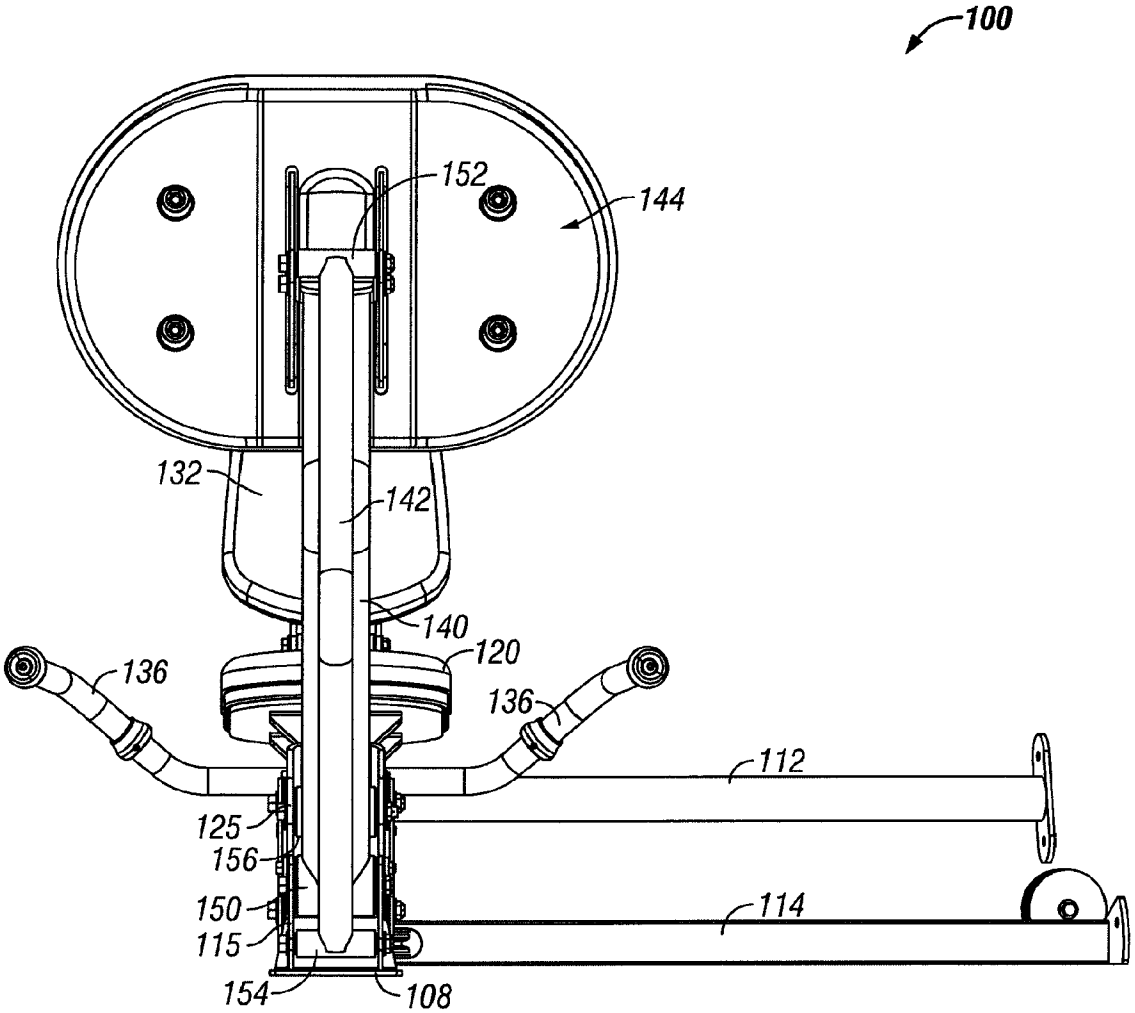
FIG. 19 is a front elevation view of the machine of FIG. 18.
Figure 20:
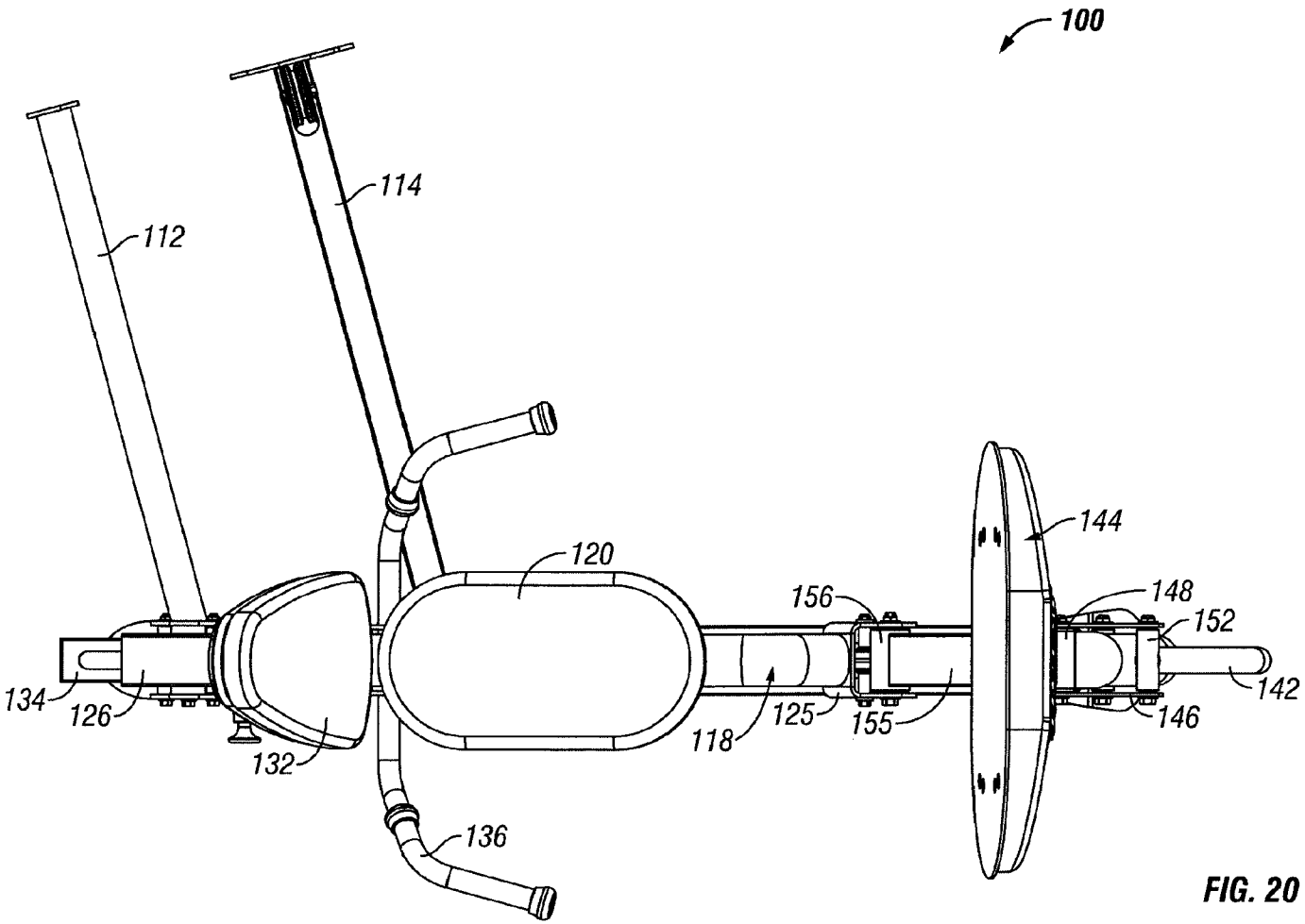
FIG. 20 is a top plan view of the machine of FIGS. 18 and 19.
Figure 21:
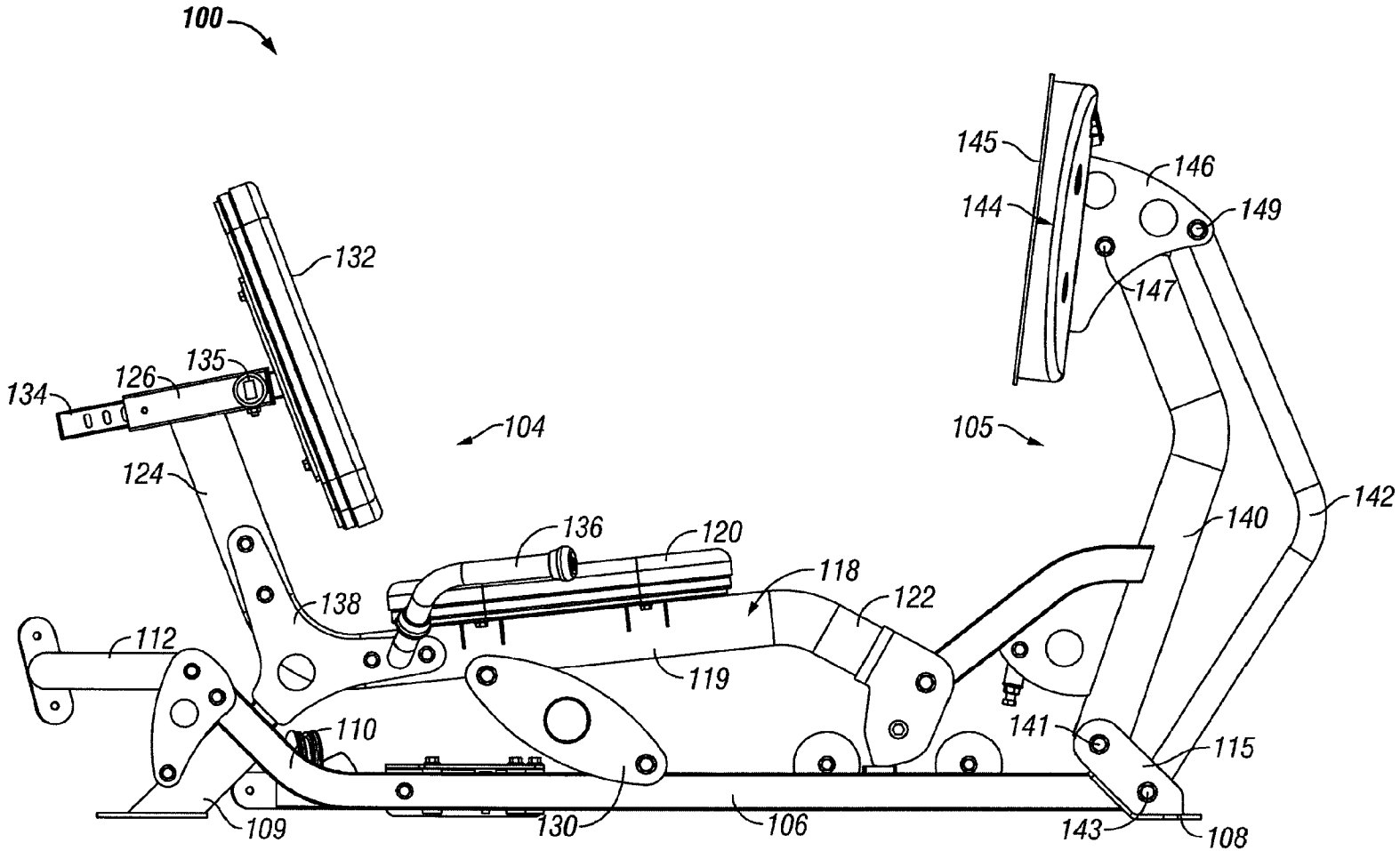
FIG. 21 is a side elevation view of the opposite side of the machine to FIG. 18.
Figure 22:
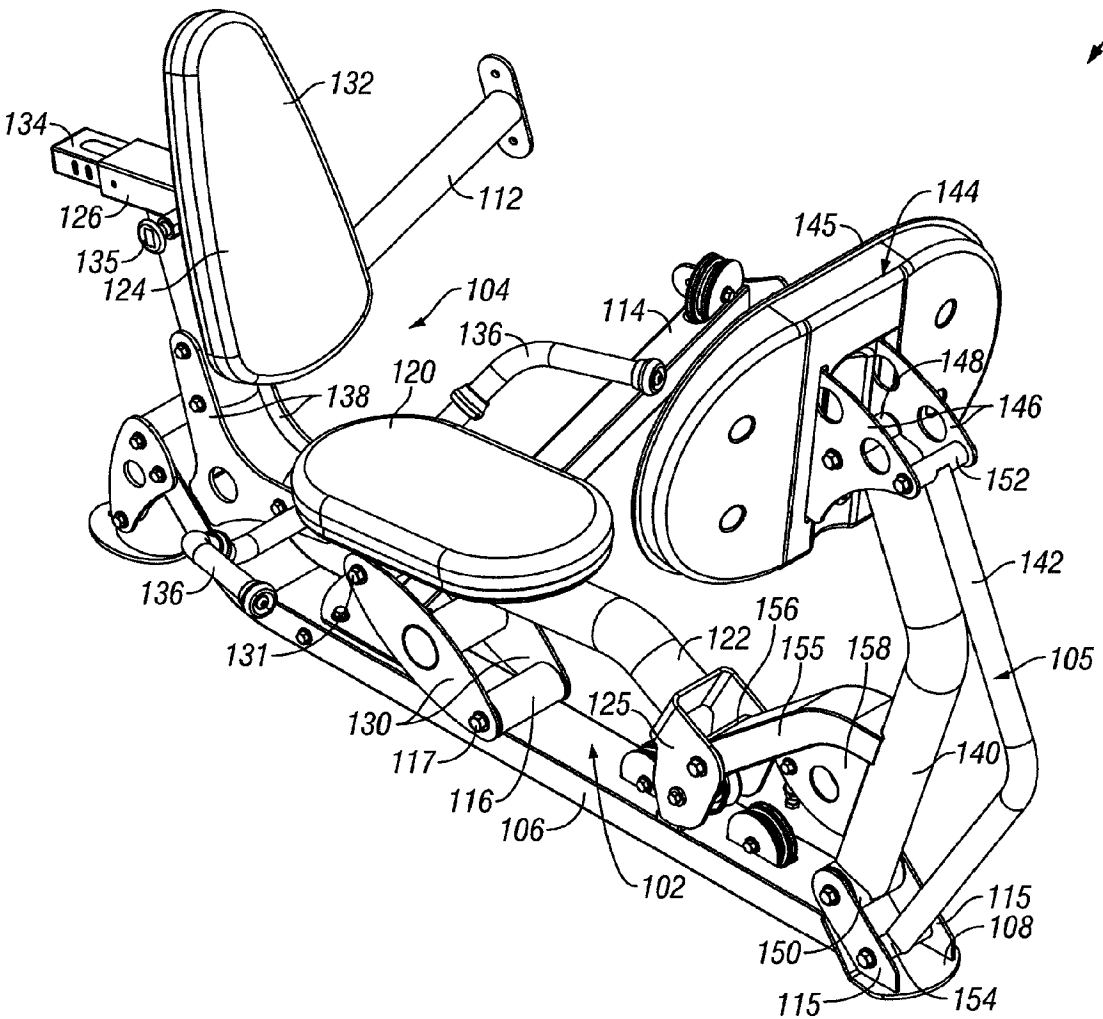
FIG. 22 is a front perspective view of the machine of FIGS. 18 to 21.
Figure 23:
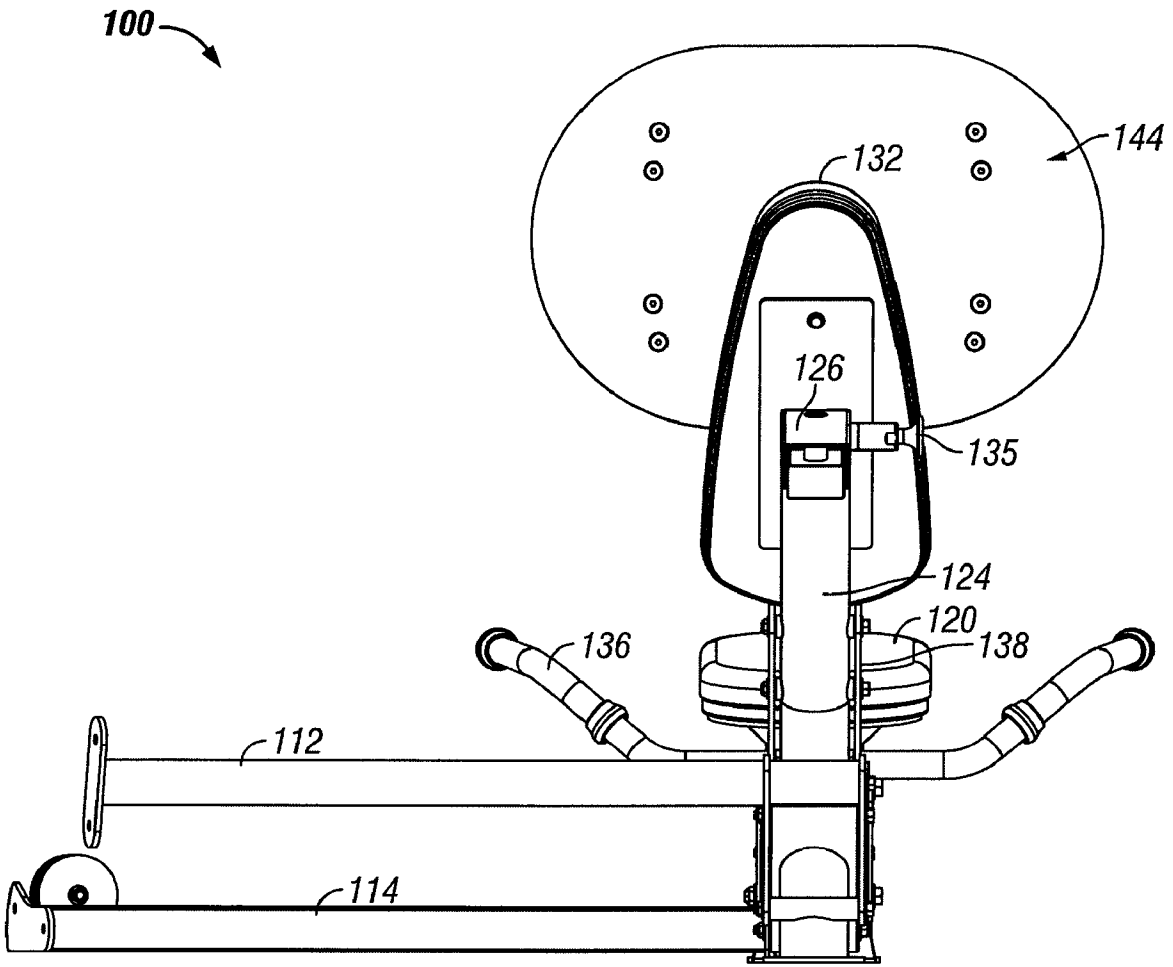
FIG. 23 is a rear elevation view of the machine of FIGS. 18 to 22.

The user support assembly 104 is different from the user support assembly of the previous embodiment since it has a back pad which is adjustable to accommodate users of different heights instead of the seat and back pad adjusting together as in machine 10, and there is no head pad in this embodiment. User support assembly 104 has a generally "Z" shaped base 118 having a central longitudinal portion 119 on which primary user support or seat pad 120 is mounted, a first, downward bending, forward end portion 122 and a second, upward bending, rear end portion 124. A pivot bracket 125 is mounted at the end of downward bending end portion 122, and a transverse receiving tube 126 is mounted at the upper end of upward bending end portion 124. A pivot mount 128 (seen in the multi-function gym version of FIG. 28) is positioned on the lower side of the central longitudinal portion 119 of the base 118 between the first and second end portions. A pair of generally oval-shaped mounting plates or pivot linkage plates 130 are each pivotally connected at their upper ends via a pivot pin extending through the pivot mount or sleeve on portion 119 of the base for rotation about pivot axis 131, and are pivotally connected at their lower ends via a pivot pin extending through the main frame pivot mount or sleeve 116 for rotation about pivot axis 117, as best illustrated in FIGS. 18 and 22. Plates 130 form the first pivot link of a four-bar pivot mounting assembly which pivotally mounts the user support assembly for rotation between the exercise start and end positions, as described in more detail below.

As noted above, the primary user support or seat pad 120 is directly mounted on top of upholstery plates positioned on the upper side of the central longitudinal portion 119 of the user support base tube. A secondary support or back pad 132 mounted on upholstery plates is connected to an adjuster tube 134 that is designed for telescopic engagement with the receiving tube 126 on the upward bending end portion 124 of the user support base tube. A pull pin 135 mounted on the receiving tube engages with a series of pinning holes located along the length of the adjuster tube to provide positioning adjustment for a user seated on the user support assembly. A pair of stabilizing supports or handles 136 is mounted on stop plates 138 which are attached to base 118 and positioned on each side of the seated user, as best illustrated in FIGS. 18 and 22. The stop plates 138 rest against the upper end 139 of rear support tube 109 in the exercise start position.

The exercise arm assembly 105 comprises a main upright 140, a secondary upright 142, and a footplate 144 pivotally mounted at the upper ends of uprights 140 and 142. Footplate 144 has a user engaging flat surface 145 facing the user support assembly 104, and a pair of mounting plates 146 projecting from the opposite side of the footplate. Each mounting plate 146 has a pair of pivot mounting holes which are aligned with corresponding mounting holes in the other plate. Both the main upright and secondary uprights are generally V-shaped. The main upright has a pivot mount 148 at its upper end pivotally connected to a pivot pin extending between the mounting plates 146 on footplate 144 for rotation about pivot axis 147, as seen in FIGS. 18 and 22. A second pivot mount 150 at the lower end of the main upright 140 is pivotally connected to pivot bracket 115 at the forward end of the base member or tube 106 of the main frame for rotation about pivot axis 141. The secondary upright 142 has a first pivot mount or sleeve 152 at its upper end which is pivotally connected to a pivot pin extending between the mounting plates 146 for rotation about pivot axis 149. Pivot axis 149 is spaced forwardly from the main upright pivot axis 147, as seen in FIG. 18. A second pivot mount 154 at the lower end of the secondary upright is pivotally connected to the forward pivot bracket 115 of the main frame base tube 106 for rotation about pivot axis 143, also at a location spaced forwardly from the pivot axis 141 of lower pivot mount 150 of the main upright 140.

An extension tube 155 extends rearward and downward from the lower section of the main upright 140 and acts as a connecting link between the exercise arm and user support. A pivot mount 156 at the lower end of extension tube 155 is pivotally secured to pivot bracket 125 at the forward end of the user support base 118 for rotation about pivot axis 127, as illustrated in FIGS. 18 and 22. Extension tube 155 therefore forms part of the second pivot link of the user support four-bar pivot assembly, along with the lower portion of main upright 140. A reinforcing plate or bracket 158 extends between the lower side of extension tube 155 and the lower section of the main upright 140, as illustrated in FIG. 18, and a cable end anchor 159 is mounted on reinforcing bracket 158.

When the machine is assembled, the lower pivot mount 154 of the secondary upright 142 is connected to first mounting holes in the forward mounting bracket 115 on the main frame, and the lower pivot mount 150 of the main upright connects to the second mounting holes on the forward mounting bracket 115. The footplate 144 is connected to the upper pivot mounts 148 and 152 on the main and secondary uprights, respectively, via spaced pairs of mounting holes located in the pair of protruding mounting plates 146. The pivoting connection between the main frame, footplate, main upright, and secondary upright forms a four-bar linkage which uses the main upright to dictate the forward movement of the footplate and the secondary upright to control the angular orientation of the footplate. During the forward motion, the angle of user engaging face of the footplate is constantly adjusted by the secondary upright to match the pivoting motion of the user's ankle.

The user support assembly is connected at its forward mounting bracket 125 to the pivot mount 156 on the exercise arm extension tube 155, and is pivotally connected to the main frame via user support pivot link plates 130 which are connected at one end to pivot mount 128 on the user support and at the other end to pivot mount 116 on the base 106 of the main frame.

Figure 24A:
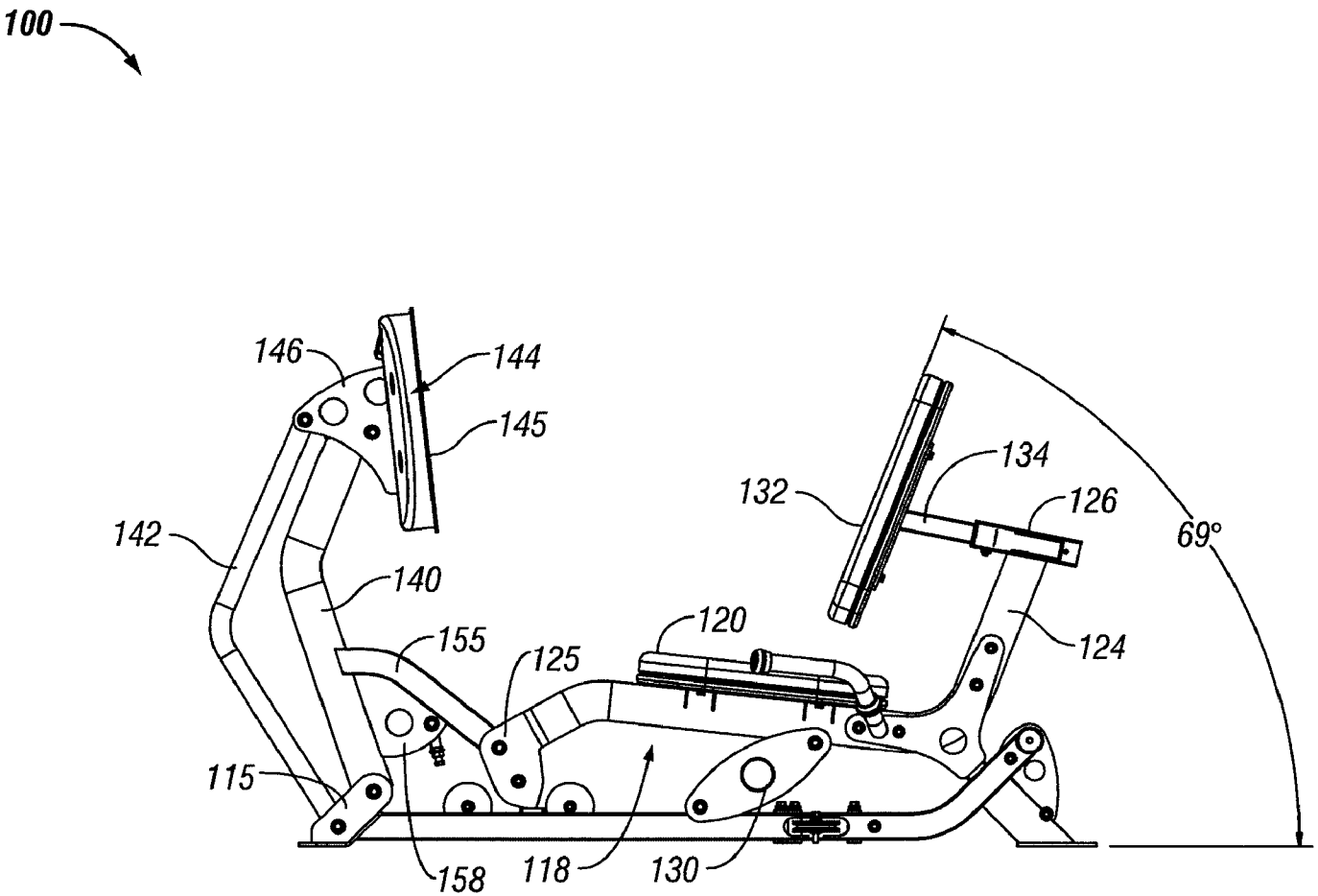
FIGS. 24A and 24B are side elevation views of the exercise machine of FIGS. 18 to 22 in the exercise start and end positions, respectively.
Figure 24B:
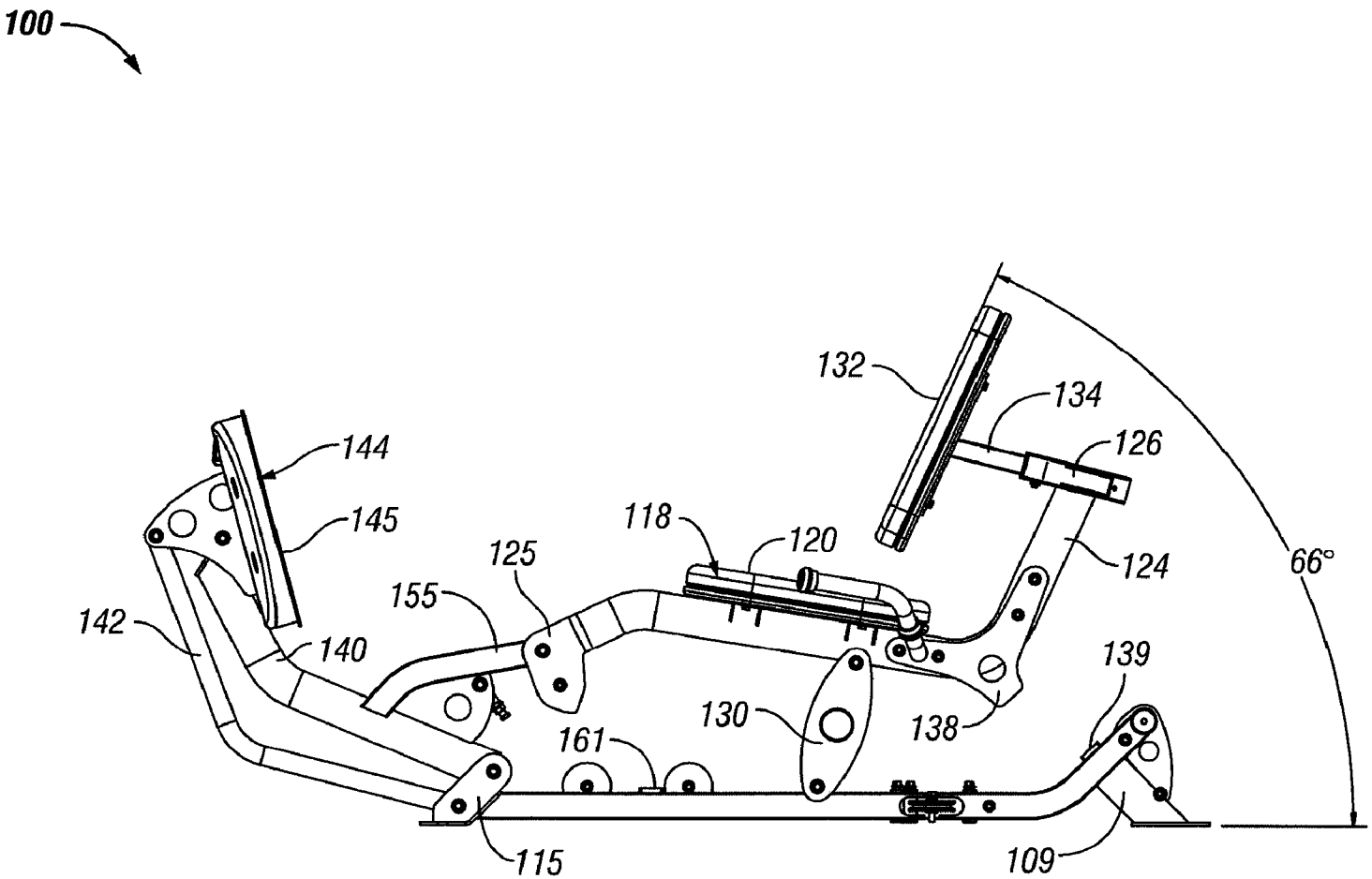
Figure 25A:
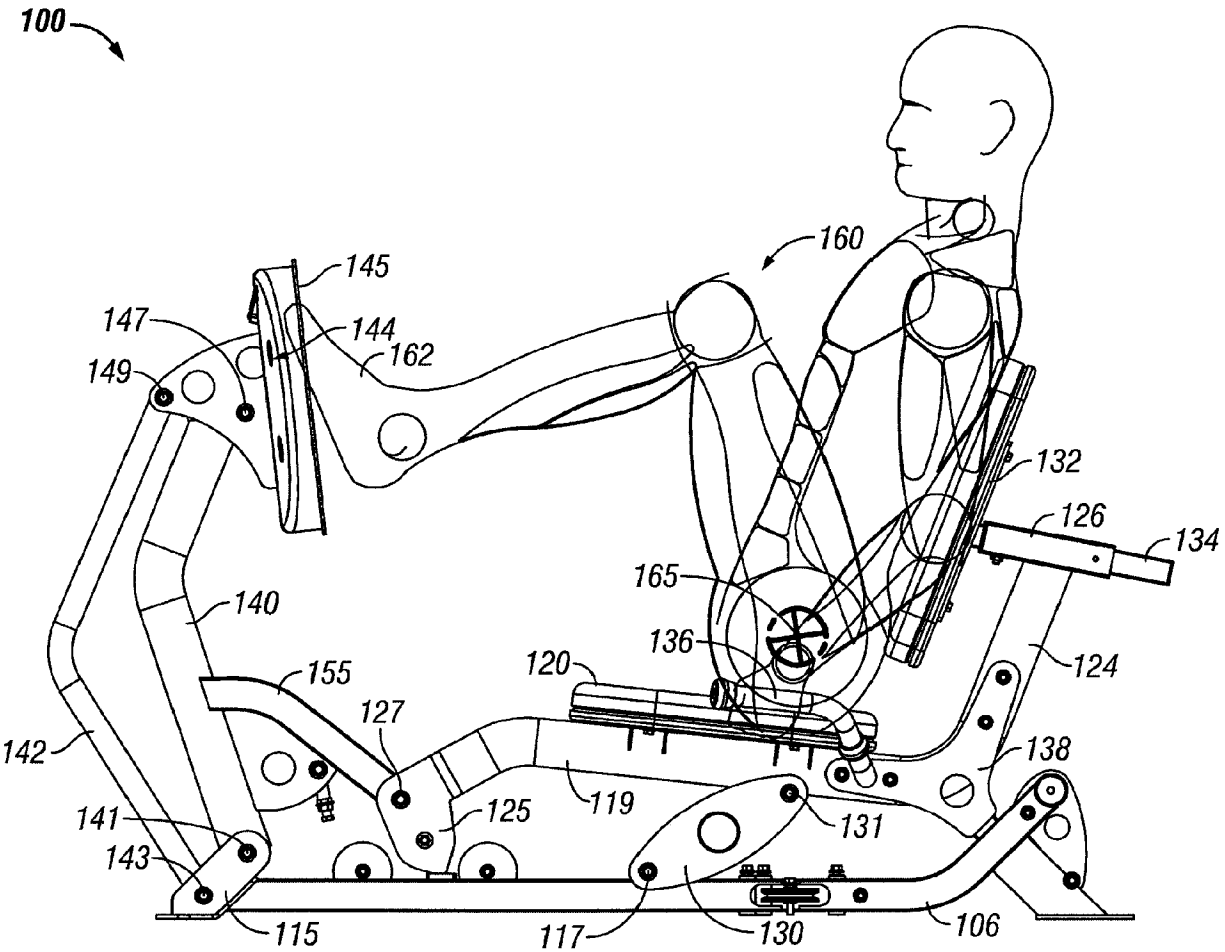
FIGS. 25A and 25B are side elevation views similar to FIGS. 24A and 24B illustrating a user seated on the machine in the leg press exercise start and end positions.
Figure 25B:
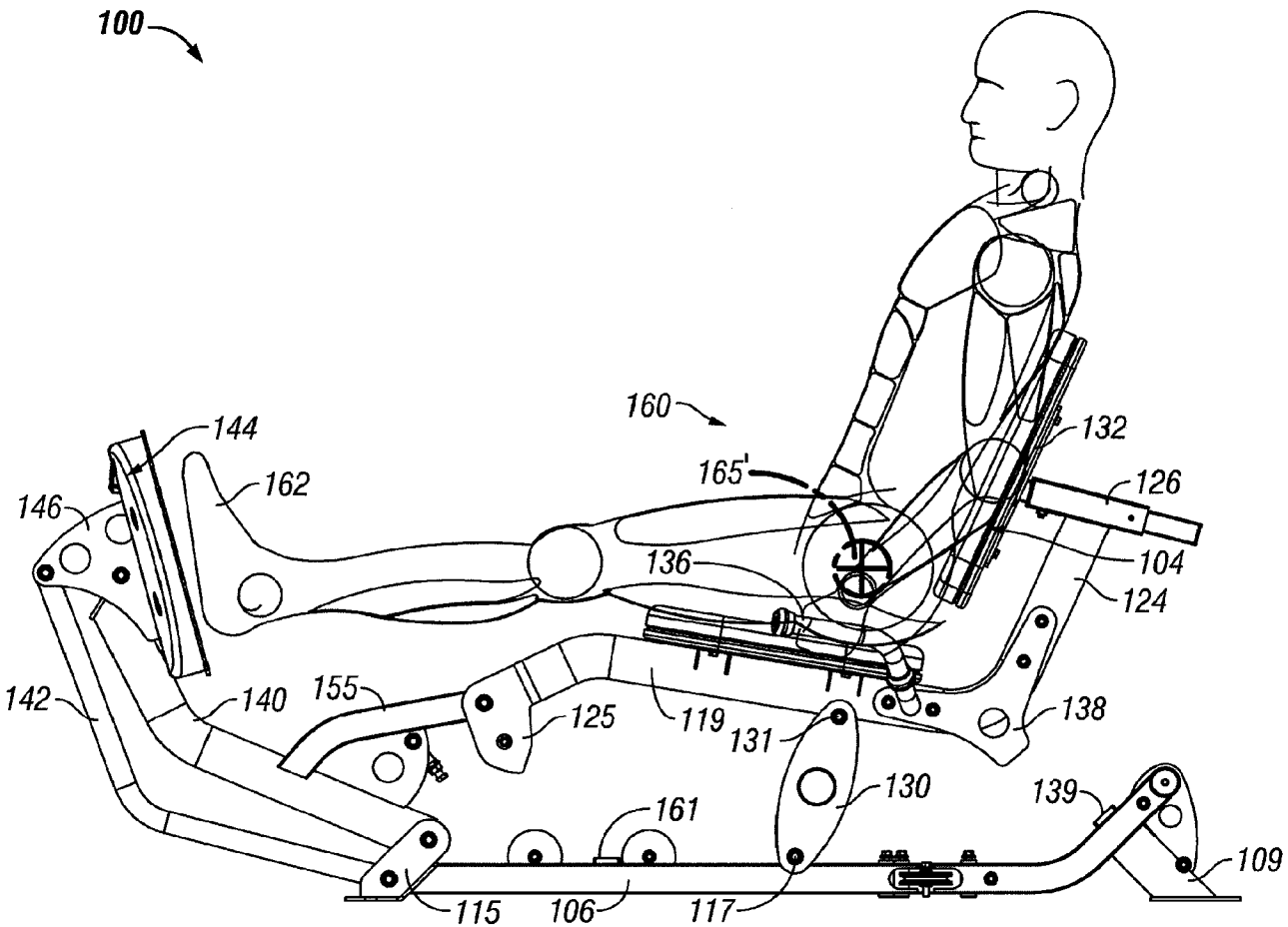

FIGS. 24A and 24B illustrate the machine 100 in the start and finish positions of a leg press exercise, respectively, while FIGS. 25A and 25B illustrate the same positions with a user 160 seated on the machine. To perform the exercise, user 160 sits on the seat 120, with their back against the back pad 132, and grabs the stabilizing hand grips 136, as illustrated in FIG. 25A. They then place their feet 162 on the user engaging footplate 144 of the exercise arm and push it forward. This moves the connecting link or extension tube 155 rearward and upward, which in turn forces the user support 104 to rotate about its pivotal connection to the main frame at pivot axes 117 and 131 via pivot link 130. The machine places the user in a back supported starting position with their feet, knees and hips in the proper alignment, then adjusts that position, following the natural pivoting movement of the angles, knees and hips as the users legs straighten, replicating the motion of a barbell squat.

FIGS. 24A and 24B show that, as the exercise arm assembly is moved forward during a leg press exercise, the connection between the exercise arm and the user support assembly at pivot bracket 125 creates movement in the user support, changing its orientation by forcing the user support pivot link 130 to rotate about its connections to both the user support assembly and the main frame. This creates a composite motion pivoting action that pulls the user support forward while it lifts and tilts the user support in a rearward direction. The angular orientations of the back pad 132 in the start and finish positions are shown in degrees in FIGS. 24A and 24B. In this embodiment, the amount of angular change in the orientation of the back pad between the start and finish position is around three degrees, with the finish position being slightly more rearwardly reclined. For added stability in the start position of FIG. 24A, the pivot bracket 125 at the forward end of the user support rests on a stop 161 on the base tube 106 of the main frame and the stop plates 138 at the rear end of the user support rests on stop 139 at the upper end of the main frame rear support tube 109. As can be seen in FIG. 24B, the pivot bracket 125 and stop plates 138 are raised up and away from the respective stops in the finish position.

In the start position of FIG. 25A, the user's feet 162 are positioned on the exercise arm footplate 144, with their knees positioned over their toes. Their upper and lower legs are bent at approximately 90 degrees, placing their thighs parallel to the position of their feet on the footplate; replicating the compressed (lowest) position of a free weight squat. The bold circle with cross hairs 165 indicates the joint or pivot point of the user's hip in the start position of a leg press exercise.

In FIG. 25B, the user is in the end position, with their legs straightened, hips positioned over their ankles as if they were standing upright. This position places the user in a safe, supported position that eliminates or reduces stress to the low back by removing or reducing its involvement in the exercise. It takes the resistive force from the footplate and transfers it straight to the user's hips, forcing their low back against the back pad (secondary support) and keeping them firmly planted in the seat (primary support). The dashed circle 165' highlights the user's hip joint in the exercise finish position.

Figure 26:
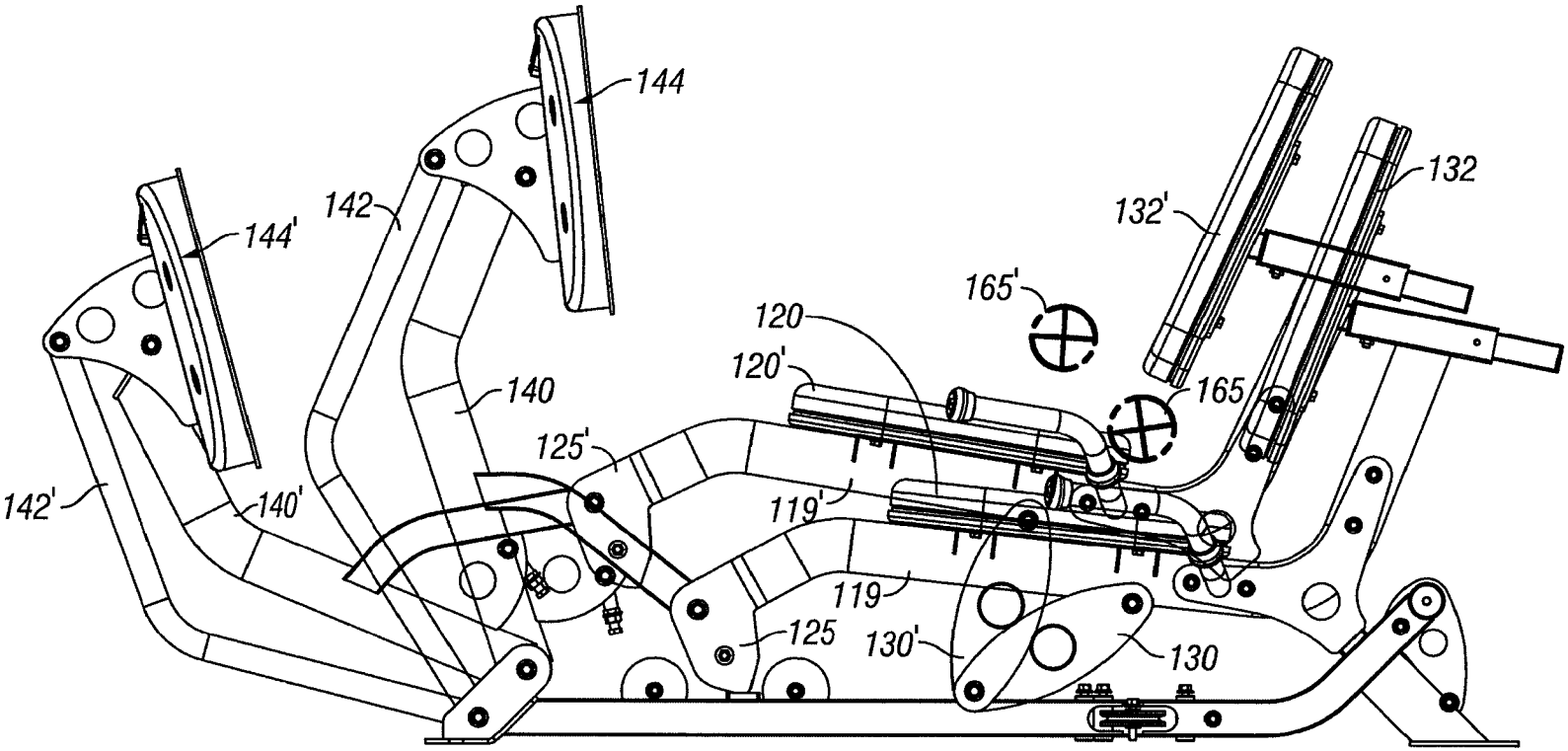
FIG. 26 is an overlay of two side views of the machine in the positions of FIGS. 24A and 24B with the relative positions of a user's hip joint in the start and end positions.

FIG. 26 is an overlay of machine 100 in the start and finish positions with the two highlighted hip joint positions 165 and 165'. In FIG. 26, the start positions of various components of the exercise machine are shown by the corresponding reference numbers without dashes, while the finish positions are shown by the same reference numbers but with a dash (') after the number. This drawing illustrates the upward and forward movement of the seated user, and also shows how the seat pad 120 travels forward, the user support pivot link 130 rotates forward and the back pad (secondary support) 132 reclines slightly rearward.

Figure 27:
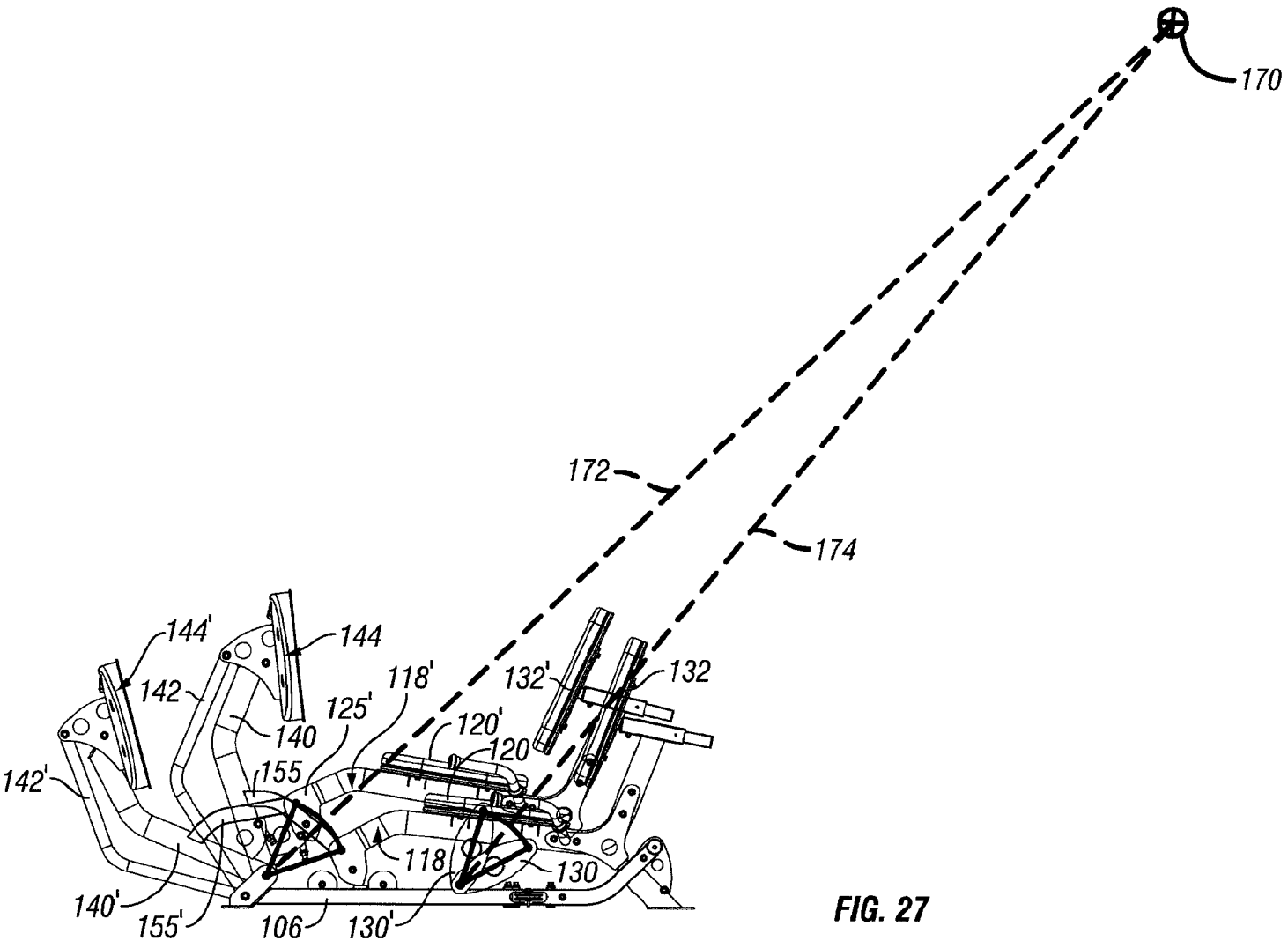
FIG. 27 is an overlay similar to FIG. 26 but on a reduced scale and illustrating the theoretical pivot point of the exercise motion.

FIG. 27 is another view similar to FIG. 26 of an overlay of the machine in the start and finish positions to highlight the pivoting action and the theoretical pivot point 170 of the exercise motion. Because the extension tube 155 of the main upright 140 of the exercise arm acts as a connecting link between the user support base 118 and the pivotal connection of the upright 140, the combination of the connecting link or tube 155, main tube 106, user support base 118 and user support pivot 130 forms a four-bar linkage. By using a four-bar linkage as the user support pivot system, all the pivoting action can take place under the user with the pivot mounts conveniently located on the main frame and user support. However the theoretical pivot 170 for the user support is actually located elsewhere. FIG. 27 illustrates the centerline 172 of the arcing movement of a first linkage bar of the four-bar linkage, specifically the connecting link 155, and the centerline 174 of the arcing movement of the second linkage bar of the four-bar linkage, specifically the user support pivot link 130. The point in space where the centerlines 172 and 174 meet forms the theoretical pivot 170 of the pivotal movement, i.e., the point where a single pivot would have to be located in order to mimic the same user support movement pattern achieved by the four-bar linkage.

A vertical line bisecting this pivot point would represent the gravitational centerline for the user support movement. As can be seen, the theoretical pivot 170 is located out in space, far behind the user. This means that the combined weight of the user and user support is distributed on directional side (side that the user support travels towards) of the gravitational centerline of the user support pivotal motion at all times, and results in the combined weight of the user and user support contributing to the exercise load. This helps offset the smaller weight stacks found on most multi-function home gyms and allows the user to achieve the exercise benefits of a heavier weight, free standing leg press at home. Because of the placement of the theoretical pivot, the user support is constantly lifting upward throughout the exercise motion which prevents or reduces resistance "drop-off" at the end of the exercise.

The advantage of the four-bar pivot system with the theoretical pivot is that it takes the movement pattern of a single point pivot that might normally be located in an area impossible to access and makes it possible.

FIGS. 28 and 29 illustrate an embodiment in which the leg press machine or unit 100 of FIGS. 18 to 27 attached to a multi-function home gym 200 which has a multi-exercise station 202 as generally known in the field, and a vertical weight stack housing 204 in which a selectorized weight stack (not visible in the drawings) is mounted on vertical guide rods. The ends of the first and second cross struts 112 and 114 are secured to machine 200 so that the leg press unit 100 is located to one side of the multi-exercise station 202. A cable and pulley linkage extends through cross strut 114 from the weight stack to the exercise arm assembly 105 to provide exercise resistance. In alternative embodiments, the machine or unit 100 may be secured to other types of multi-function home gyms or other exercise machines to provide an additional exercise station, or may be a stand-alone machine suitably connected to its own exercise resistance. The user support in unit 100 of FIGS. 28 and 29 is slightly modified to include a head rest, but is otherwise identical to the user support 104 of the embodiment of FIGS. 18 to 27.

In each of the above embodiments, by linking the movement of the user support to that of the exercise arm, the user position is continually adjusted to that of the footplate during the exercise movement. Although the user is supported in a fixed, stable manner on the user support or seat assembly, the moving user support recruits the involvement of core stabilizing muscles as the user's position adjusts during the exercise. By linking the movement of the user support to that of the exercise arm, the above embodiments provide the user with a safer, more comfortable leg press exercise movement that mimics the natural lower body alignment found in a free weight squat exercise.

This composite motion exercise movement has the exercise arm and user support traveling in a dependent relationship that compensates for the exaggerated arcing movement found in prior art leg press machines that utilize a pivoting exercise arm or the unnatural straight line movement found in prior art leg press machines that utilize a linear movement exercise arm. The above embodiments mimic natural starting and finishing positions found in the free weight squat exercise and provide a relatively safe exercise movement where the position of the user support adjusts to the position of the exercise arm, providing support and body alignment based on that position.

The linked relationship between the movement of the actuating member or exercise arm and the movement of the user support in the above embodiments means that, when the exercise arm is actuated, it causes the user support to be moved. In the embodiment of FIGS. 1 to 17, the user support movement is in an upward and forward direction, while the user's body position moves rearward away from the exercise arm, in a generally straight line. In the embodiment of FIGS. 18 to 29, the user's body position moves upward and forward. In other alternative embodiments, the user support movement may be in an upward and rearward direction. In the above embodiments, the user support seat travels in the same direction as the exercise arm, but may travel in the opposite direction in alternative embodiments. The purpose of the composite movement system is to maintain a predetermined relationship between the user and their engagement position on the exercise arm, throughout the entire exercise movement. Another purpose is to provide a safer exercise movement where the position of the user support adjusts to the position of the exercise arm and provides support based on that position. A further purpose is to provide a more comfortable, better feeling exercise that enhances the user's workout.

In both of the above embodiments, the user support connects directly to the exercise arm so that pivotal movement in the arm results in the self-aligning movement of the user support. In other embodiments, this self-aligning movement could also be used on a linear movement exercise arm to produce an enhanced exercise motion that constantly aligns the position of the user to that of the user engaging portion of an exercise arm. The movement of the user support can be in the same direction as the arm or in the opposite direction. The combined weight of the user and user support may have little effect on the resistive load, as in the first embodiment, or may contribute to the load, as in the second embodiment, dependent on the location of the gravitational centerline of the theoretical pivot.

It should be understood that all the different elements used in the two embodiments may be mixed and interchanged with one another and still incorporate the essence of the above embodiments. The seat pad or back pad, or both, could be fixed or made adjustable. The exercise arms could be one piece (dependent) or two-piece (independent), and can have rotational or linear movement and can be mounted on the main frame, user support or connecting link. The connecting links could be made adjustable and could push or pull to urge rotation of the user support which can be made to rotate forward or rearward. Any of the embodiments could have the resistance associated with any of the moving parts (user support, exercise arm or connecting link).

It should also be noted that different types and forms of components could be used in the above embodiments. Cables could be replaced with belts, ropes, chains or the like, pulleys replaced with sprockets, and tubes could be replaced with solid rods or bars. The seat, back pad, and/or foot plate may be made adjustable. Other types of resistance known to the art could by used for providing exercise resistance, such as hydraulic, pneumatic, electro-magnetic or elastic band resistance devices.

The above description of the disclosed embodiments is provided to enable any person skilled in the art to make or use the invention. Various modifications to these embodiments will be readily apparent to those skilled in the art, and the generic principles defined herein can be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. A leg press exercise machine, comprising:

a stationary main frame;

a user support assembly which supports a user in an exercise position;

a user support pivot mount which pivotally mounts the user support assembly for movement about a user support pivot axis relative to the main frame between a start position and an end position during a leg press exercise, at least part of the pivot mount being spaced beneath the user support assembly;

the user support assembly having primary and secondary supports which support spaced positions on a user's body throughout an exercise, the primary support supporting the majority of the user's weight at least in the start position and the secondary support being fixed at a predetermined angular orientation relative to the primary support at least during a leg press exercise, the primary and secondary supports moving together about the user support pivot axis at the same relative orientation throughout the leg press exercise;

the user support pivot axis defining a vertical gravitational center line which extends vertically through the user support pivot axis and is positioned such that portions of the user support assembly are located on both sides of the gravitational center line in at least the exercise start position;

a leg press exercise arm assembly movably mounted relative to the main frame and having at least one main exercise arm and at least one user engaging footplate which is engaged by the feet of a user positioned on the user support to perform a leg press exercise;

at least one connecting link between said at least one main exercise arm and the user support assembly which directly links movement of the leg press exercise arm assembly to movement of the user support assembly; and a load which resists movement of at least one of the user support assembly, leg press exercise arm assembly, and the at least one connecting link.

2. The machine of claim 1, wherein the pivot mount comprises a multiple pivot assembly pivotally mounting the user support assembly for rotation relative to the main frame between the start position and the end position, the pivot assembly having multiple pivots which together define the user support pivot axis and the vertical gravitational center line which extends through the user support pivot axis.

3. The machine of claim 2, wherein the multiple pivot assembly comprises a four-bar pivot linkage.

4. The machine of claim 3, wherein the four-bar pivot linkage comprises a first pivot link extending between the user support assembly and main frame, and a second pivot link between the user support assembly and the at least one main exercise arm, the second pivot link further comprising the at least one connecting link which translates movement of the leg press exercise arm assembly into movement of the user support assembly.

5. The machine of claim 4, wherein the second pivot link is spaced forward from the first pivot link.

6. The machine of claim 4, wherein the second pivot link of the four-bar pivot linkage has a first pivot connection between the user support assembly and the at least one main exercise arm, and a second pivot connection between the at least one main exercise arm and main frame.

7. The machine of claim 4, wherein the first pivot link is pivotally associated with the main frame at a first position for rotation about a first pivot axis and pivotally associated with the user support assembly at a second position for rotation about a second pivot axis.

8. The machine of claim 7, wherein the second pivot axis moves forward as the user support assembly moves from the start to the end position of a leg press exercise.

9. The machine of claim 4, wherein the user support assembly has a forward portion extending forward from the primary and secondary supports towards the leg press exercise arm assembly, and the second pivot link pivotally associates the at least one main exercise arm with the forward portion of the user support assembly for rotation about a third pivot axis.

10. The machine of claim 9, wherein the second pivot link includes part of the at least one main exercise arm which is pivotally associated with the main frame for rotation about a fourth pivot axis spaced forward from the third pivot axis.

11. The machine of claim 1, wherein the vertical gravitational center line of the user support pivot axis extends through the user support assembly in both the exercise start and end positions.

12. The machine of claim 1, wherein the user support assembly has a forward portion which is directly pivoted to the at least one main exercise arm.

13. The machine of claim 1, wherein the user support assembly further comprises a third support which supports a different part of a user's body from the primary and secondary supports.

14. The machine of claim 13, wherein the user support assembly comprises a user support base which is pivotally mounted relative to the main frame, a user support frame, an adjustment mechanism which adjustably mounts the user support frame on the user support base, and a locking device which locks the user support frame at an adjusted position on the user support base, and at least one of the primary, secondary and third user supports is mounted on the user support frame.

15. The machine of claim 14, wherein the primary and secondary supports are mounted on the user support frame, the adjustment mechanism comprises a slide mechanism and the user support frame is slidably mounted to adjust the spacing between the primary and secondary supports and the at least one user engaging footplate.

16. The machine of claim 14, wherein at least two of the primary, secondary and third supports are mounted on the user support frame.

17. The machine of claim 14, wherein the primary, secondary and third supports are mounted on the user support frame.

18. The machine of claim 1, wherein the primary support comprises a seat pad which supports a user in a seated position throughout the exercise.

19. The machine of claim 18, wherein the secondary support comprises a back pad.

20. The machine of claim 19, further comprising a head pad located on the user support assembly above the back pad.

21. The machine of claim 19, further comprising a third support on the user support assembly which supports a different part of a user's body from the seat and back pad.

22. The machine of claim 21, wherein the third support comprises handles located on the user support assembly on opposite sides of the seat pad.

23. The machine of claim 1, wherein said at least one user engaging foot plate is pivotally mounted to rotate relative to the at least one main exercise arm during a leg press exercise to allow alignment with the user's feet during the exercise.

24. The machine of claim 23, further comprising a multiple pivot assembly pivotally mounting the at least one user engaging foot plate which allows rotation of the at least one user engaging foot plate relative to the main exercise arm between a start position and an end position during a leg press exercise, the pivot assembly having multiple pivots which define a theoretical pivot axis of the pivotal movement of the at least one user engaging foot plate.

25. The machine of claim 24, wherein the at least one main exercise arm comprises a main upright pivotally associated with the user support assembly and the at least one user engaging foot plate and a secondary upright spaced forward from the main upright and pivotally associated with the main frame and the foot plate.

26. The machine of claim 25, wherein the main upright is also pivotally associated with the main frame.

27. The machine of claim 1, wherein the at least one connecting link is a direct pivot connection between the user support assembly and the at least one main exercise arm.

28. A leg press exercise machine, comprising:

a stationary main frame;

a user support assembly pivotally mounted relative to the main frame to support a user in an exercise position and movable in a user support pivotal movement between a start position and an end position during a leg press exercise, the user support assembly having primary and secondary supports which support spaced positions on a user's body throughout an exercise, the primary support supporting a major part of the user's weight at least in the start position, the secondary support being fixed at a predetermined angular orientation relative to the primary support at least during a leg press exercise, and the primary and secondary supports moving together at the same relative orientation throughout the leg press exercise;

a leg press exercise arm assembly movably mounted relative to the main frame and having at least one main exercise arm and at least one user engaging footplate which is engaged by the feet of a user positioned on the user support to perform a leg press exercise;

at least one connecting link between said at least one main exercise arm and the user support assembly which directly links movement of the leg press exercise arm assembly to movement of the user support assembly; and a load which resists movement of at least one of the user support assembly, leg press exercise arm assembly, and the at least one connecting link;

wherein the user support assembly rotates rearward from the start to the end position of an exercise and both the primary and secondary supports are rearwardly reclined at the end of an exercise, placing a user in a more reclined position at the end of the exercise.

29. The machine of claim 28, wherein the user support assembly has an adjustment mechanism which allows adjustment of at least one of the primary and secondary supports prior to an exercise to adjust for different size users, the adjustment mechanism including a locking device to lock the at least one of the primary and secondary supports in the adjusted position throughout the exercise.

30. The machine of claim 29, wherein the user support assembly comprises a user support frame which is pivotally mounted relative to the main frame, and the primary and secondary supports are positioned at spaced locations on the user support frame, one of the primary and secondary supports being adjustably mounted on the user support frame via the adjustment mechanism.

31. The machine of claim 28, wherein the user support assembly moves forward as it rotates rearward during an exercise.

32. The machine of claim 28, wherein the user support assembly, leg press exercise arm assembly, and at least one connecting link comprise a first exercise station, and a second additional exercise station is mounted on the stationary main frame for performing a second, different exercise.

33. The multi-station gym of claim 32, wherein the load provides exercise resistance for both the first and second exercise stations.

34. The multi-station gym of claim 32, wherein the leg press exercise assembly includes a main exercise arm and a pivot mount which pivotally mounts the user engaging footplate on the main exercise arm to allow alignment with the user's feet throughout a leg press exercise.

35. The multi-station gym of claim 34, wherein the pivot mount of the user engaging footplate comprises a four-bar pivot linkage.

36. The multi-station gym of claim 34, wherein the main exercise arm comprises a main upright having a first pivot connection to the stationary main frame and a second pivot connection to the user engaging footplate, and a secondary upright spaced forward from the main upright and having a third pivot connection to the stationary main frame and a fourth pivot connection to the user engaging footplate.

37. The multi-station gym of claim 36, wherein the main upright has a rearward extension which is pivotally connected to the user support assembly, the rearward extension comprising the at least one connecting link.

38. The multi station gym of claim 37, wherein the main upright is generally L-shaped and has an upward bend, and the rearward extension is an integral part of the L-shape which extends rearward from the upward bend.

39. The multi-station gym of claim 37, wherein the main upright has spaced upper and lower ends, and the rearward extension comprises a strut extending rearward from the main upright at a location spaced between the upper and lower ends.

40. The multi-station gym of claim 32, further comprising a four-bar pivot linkage between the user support assembly and stationary main frame which defines the pivotal movement of the user support assembly between the start and end position of an exercise.

41. The multi-station gym of claim 32, wherein the primary and secondary supports are fixed relative to one another throughout an exercise and move together in the same relative orientation to one another throughout the exercise.

42. A leg press exercise machine, comprising:

a stationary main frame having a forward end and a rear end;

a user support assembly movably mounted relative to the main frame to support a user in an exercise position and movable between a start position and an end position during a leg press exercise movement, the user support assembly having a primary support and a secondary support which support spaced positions on a user's body throughout an exercise, the primary support being configured to support the majority of a user's weight at least in the start position of the exercise and the primary and secondary supports moving together throughout the exercise movement;

a multiple pivot assembly pivotally mounting the user support assembly for rotation in a user support pivotal movement path relative to the main frame between the start position and the end position, the pivot assembly having multiple pivots which define a theoretical pivot axis about which the user support assembly rotates in said user support pivotal movement path and a vertical gravitational center line which extends through the theoretical pivot axis, the user support assembly rotating rearward between the start and end position and being in a more reclined position in the end position of the leg press exercise movement;

a leg press exercise arm assembly movably mounted relative to the main frame and having at least one main exercise arm and at least one user engaging foot plate which is engaged by the feet of a user positioned on the user support to perform a leg press exercise;

at least one connecting link which translates movement of the leg press exercise arm assembly to movement of the user support frame; and a load which resists movement of at least one of the user support assembly, leg press exercise arm assembly, and the at least one connecting link.

43. The machine of claim 42, wherein the user support assembly has a forward end portion and the at least one connecting link is directly connected between the forward end portion of the user support assembly and the leg press exercise arm assembly.

44. The machine of claim 43, wherein the leg press exercise arm assembly has a main upright having a first pivot connection to the at least one user engaging foot plate and a second pivot connection to the forward end portion of the user support assembly, the second pivot connection comprising at least part of the at least one connecting link.

45. The machine of claim 44, further comprising a third pivot connection between the main upright and the main frame at a location spaced forward from the second pivot connection, the second and third pivot connection comprising two pivots of the multiple pivot assembly which pivotally mounts the user support assembly on the main frame for movement between the exercise start and end positions.

46. The machine of claim 45, wherein the multiple pivot assembly further comprises a pivot link pivoted between the user support and main frame and spaced rearward from the main upright.

47. The machine of claim 46, wherein the pivot link is positioned at least partially below the primary support.

48. The machine of claim 44, wherein the leg press exercise arm assembly has a secondary upright spaced forward from the main upright and pivotally connected between the at least one user engaging foot plate and the main frame.

49. The machine of claim 42, wherein the user support assembly moves in an upward and forward direction between the start and end position of an exercise.

50. The machine of claim 42, wherein the at least one connecting link is movably associated with the leg press exercise arm assembly and at least one of the stationary main frame, user support assembly, and user support multiple pivot assembly.

51. The machine of claim 42, wherein the user support assembly comprises a generally L-shaped frame having a base portion and a rear, generally upwardly extending portion, the primary support comprising a seat pad mounted on the base portion and the secondary support comprising a back pad mounted on the upwardly extending portion.

52. The machine of claim 51, wherein the user support assembly further comprises a base support associated with the multiple pivot assembly, the base support having an elongate portion, and a slide mechanism which slidably mounts the L-shaped frame on the elongate portion of the base support for adjustment of the position of the primary and secondary user supports relative to the leg press exercise arm assembly, the slide mechanism including a locking device which releasably locks the L-shaped frame in an adjusted position during an exercise.

53. The machine of claim 51, further comprising an adjustable mounting device which adjustably mounts the back pad on the upwardly extending portion of the L-shaped frame for adjustment of the spacing between the back pad and upwardly extending portion, and a releasable locking device releasably engages the adjustable mounting device to lock the back pad in a selected position.

54. The machine of claim 42, wherein the primary and secondary supports are fixed relative to one another at least during an exercise and move together in the same relative orientation during an exercise.

55. A leg press exercise machine comprising:

a stationary main frame;

a user support assembly pivotally mounted relative to the stationary main frame to support a user in an exercise position and movable in a user support pivotal movement about a user support pivot axis between a start position and an end position during a leg press exercise, the user support assembly having primary and secondary supports which support spaced positions on a user's body throughout an exercise, and the primary and secondary supports moving together about the user support pivot axis at the same relative orientation throughout the leg press exercise;

the user support pivot axis defining a vertical gravitational center line which extends vertically through the user support pivot axis, portions of the user support assembly being located on both sides of the gravitational center line in at least the exercise start position;

the user support assembly moving in an upward and rearward direction between the start and end position of an exercise;

a leg press exercise arm assembly movably mounted relative to the main frame and having at least one main exercise arm and at least one user engaging foot plate which is engaged by the feet of a user positioned on the user support to perform a leg press exercise;

at least one connecting link which translates movement of the leg press exercise arm assembly to movement of the user support frame; and a load which resists movement of at least one of the user support assembly, leg press exercise arm assembly, and the at least one connecting link.

56. A leg press exercise machine, comprising:

a stationary main frame;

a user support assembly which supports a user in an exercise position;

a user support pivot mount which pivotally mounts the user support assembly for movement about a user support pivot axis relative to the main frame between a start position and an end position during a leg press exercise;

primary and secondary supports on the user support assembly which support spaced positions on a user's body throughout an exercise, the primary and secondary supports moving together throughout the exercise movement and the primary support supporting the majority of the user's weight at least in the start position of a leg press exercise;

the user support pivot mount defining a vertical gravitational center line which extends through the user support pivot axis, the vertical gravitational center line extending through at least one of the primary and secondary supports of the user support assembly during at least part of the leg press exercise;

a leg press exercise arm assembly movably mounted relative to the main frame and having at least one main exercise arm and at least one user engaging foot plate which is engaged by the feet of a user positioned on the user support assembly to perform a leg press exercise, the at least one main exercise arm comprising at least one main upright and at least one secondary upright each pivotally connected between the stationary main frame and the at least one user engaging foot plate, at least part of the at least one main upright and the at least one secondary upright extending in a generally upward direction at least in an exercise start position;

at least one connecting link which translates movement of the leg press exercise arm assembly to movement of the user support assembly; and a load which resists movement of at least one of the user support assembly, leg press exercise arm assembly, and at least one connecting link.

57. The machine of claim 56, wherein the at least one main upright is located rear of the at least one secondary upright and the at least one connecting link comprises a rearward extension between the at least one main upright and the user support assembly.

58. The machine of claim 57, wherein the at least one main upright is a generally L-shaped member having an upward bend, and the rearward extension comprises a lower portion of the L-shaped member extending rearward from the upward bend to a forward end of the user support assembly.

59. The machine of claim 57, wherein the at least one connecting link further comprises a pivot connection between the rearward extension of the at least one main upright and a forward portion of the user support assembly.

60. The machine of claim 56, wherein the user support pivot mount comprises a four-bar pivot linkage having a first link located beneath the user support assembly and a second link located in front of the user support assembly.

61. The machine of claim 60, wherein the first link is pivotally associated with the user support assembly for rotation about a first pivot axis and pivotally associated with the stationary main frame for rotation about a second pivot axis.

62. The machine of claim 60, wherein the second link is pivotally associated with the user support assembly for rotation about a third pivot axis and pivotally associated with the stationary main frame for rotation about a fourth pivot axis.

63. The machine of claim 60, wherein at least part of the second link comprises a rearward extension of the at least one main upright.

64. The machine of claim 56, wherein the primary and secondary supports are fixed relative to one another at least during an exercise and move together in the same relative orientation throughout the exercise.

* * * * *